US006174660B1

(12) United States Patent
Nakamura et al.

(10) Patent No.: US 6,174,660 B1
(45) Date of Patent: Jan. 16, 2001

(54) SILVER HALIDE PHOTOGRAPHIC LIGHT-SENSITIVE MATERIAL

(75) Inventors: Takesi Nakamura; Katsumasa Yamazaki, both of Odawara (JP)

(73) Assignee: Konica Corporation, Tokyo (JP)

( * ) Notice: Under 35 U.S.C. 154(b), the term of this patent shall be extended for 0 days.

(21) Appl. No.: 09/357,513

(22) Filed: Jul. 16, 1999

(30) Foreign Application Priority Data

Jul. 21, 1998 (JP) ..... 10-204994

(51) Int. Cl.[7] ..... G03C 1/93; G03C 1/76; G03C 1/30; G03C 1/31; G03C 1/38

(52) U.S. Cl. ..... 430/532; 430/539; 430/545; 430/546; 430/557; 430/622; 430/638; 430/639; 430/640; 430/963

(58) Field of Search ..... 430/539, 622, 430/638, 639, 640, 532, 545, 546, 557, 963

(56) References Cited

U.S. PATENT DOCUMENTS 3,429,708 * 2/1969 Klinger et al. ..... 430/638
4,444,926 * 4/1984 Ogawa et al. ..... 430/640
4,762,776 * 8/1988 Vesawa et al. ..... 430/637
5,075,209 * 12/1991 Sasaki ..... 430/638

FOREIGN PATENT DOCUMENTS 0 253 534 A2 1/1988 (EP) .
0 727 703 A1 8/1996 (EP) .
2 090 009 6/1982 (GB) .

* cited by examiner

*Primary Examiner*—Richard L. Schilling
(74) *Attorney, Agent, or Firm*—Frishauf, Holtz, Goodman, Langer & Chick, P.C.

(57) ABSTRACT

A silver halide photographic light-sensitive material comprising a support having thereon at least a light-sensitive silver halide emulsion layer containing a light-sensitive silver halide emulsion and at least a nonlight-sensitive layer, wherein said silver halide photographic light-sensitive material contains a compound represented by the following formula (1) and said silver halide photographic light-sensitive material further contains a vinylsulfone group containing hardener.

$$HOCH_2(CHOH)_mCH_2OH \qquad \text{Formula (1)}$$

wherein m represents an integer of 0 to 6.

10 Claims, No Drawings

SILVER HALIDE PHOTOGRAPHIC LIGHT-SENSITIVE MATERIAL

FIELD OF THE INVENTION

The present invention relates to a silver halide photographic light-sensitive material and a processing method thereof, specifically to the silver halide photographic light-sensitive material with excellent scratch resistance of unexposed silver halide photographic light-sensitive material, excellent rapid hardening capability, minimal sharpness loss of printed silver halide photographic light-sensitive material over passage of time, excellent scratch resistance when an exposed silver halide photographic light-sensitive material is immersed in a processing solution and excellent color dye forming capability of a yellow coupler.

BACKGROUND OF THE INVENTION

With increased popularity of a silver halide photographic light-sensitive material (hereinafter referred to as a photographic light-sensitive material or simply a light-sensitive material), there have been a strong demand for improved stability of unexposed light-sensitive material stored over a long period of time, improved handling of said light-sensitive material and improved productivity of said light-sensitive material.

In the case of photographic color paper, it is used mainly in photographic laboratories and photographic shops, and is preferably refrigerated prior to use after manufacture so as to keep its photographic properties. However, it is sometimes actually left for a long time without refrigeration in transporting it and also in the photographic laboratoies and the photographic shops where it is employed. Further, in certain regions, the paper is often left for a long time under conditions of high temperature and/or high humidity. When an unexposed photographic color paper is left for a long time as mentioned above, fogging occasionally results on the print, therefore improvement to minimize said fogging has been strongly desired.

When the unexposed photographic color paper is transferred at high speed in a printer, it is occasionally subjected to excessive scratch. In order to improve the scratch resistance, various methods have been proposed, however these methods have been insufficient improvement and still more improved methods have been sought.

In manufacturing these photographic materials, in order to obtain desirable photographic layer properties, these photographic materials are occasionally stored in the manufacturing plant for a few days prior to transportation of them after being coated. However, if the photographic material is capable of being hardened rapidly, it can be immediately transported just after coating resulting in enhancement of its productivity.

Further, an image obtained by processing the photographic material is often stored under various conditions. Specifically, in the case of photographic color paper, the obtained image is required to remain unchanged for a long time. However, since the image of the photographic color paper is often left under conditions of high temperature and/or high humidity, the image resolution is occasionally lowered, and improvement of the current image resolution has been desired.

On the other hand, in recent years, rapid development processing of the photographic light-sensitive material has become more and more popular. In this case, specifically photographic color paper is transferred at high speed when processed in a processing solution, occasionally resulting in scratch of the photographic color paper. Therefore, improvement of the scratch resistance of the paper has been strongly sought. Further, in point of rapid process, a light-sensitive material with more excellent dye forming efficiency and a processing method of said light-sensitive material have been also strongly sought.

SUMMARY OF THE INVENTION

Accordingly, an object of the present invention is to provide a silver halide photographic light-sensitive material with excellent fog resistance when an unexposed photographic light-sensitive material is stored, excellent scratch resistance of the unexposed photographic light-sensitive material, excellent rapid hardening capability, less sharpness loss when a printed photographic light-sensitive material is stored over passage of time, excellent scratch resistance when an exposed silver halide photographic light-sensitive material is immersed in a processing solution, and excellent color forming capability of a yellow coupler.

DETAILED DESCRIPTION OF THE INVENTION

The above-mentioned object of the present invention are attained by the following constitution.

1. A silver halide photographic light-sensitive material comprising a support having thereon at least a light-sensitive silver halide emulsion layer containing a light-sensitive silver halide emulsion and at least a nonlight-sensitive layer, wherein said silver halide photographic light-sensitive material contains a compound represented by the following Formula (1) and said silver halide photographic light-sensitive material further contains a vinylsulfone group containing hardener;

$$HOCH_2(CHOH)_mCH_2OH \qquad \text{Formula (1)}$$

wherein m represents an integer of 0 to 6.

2. The silver halide photographic light-sensitive material of item 1,
wherein said light-sensitive silver halide emulsion consists of an average silver chloride content ratio of not less than 95 mol %.

3. The silver halide photographic light-sensitive material of item 2,
wherein said silver halide photographic light-sensitive material comprises a nonlight-sensitive layer, coated farthest from said support, containing a betaine type surfactant.

4. The silver halide photographic light-sensitive material of item 2,
wherein said silver halide photographic light-sensitive material comprises a nonlight-sensitive hydrophilic colloidal layer coated in a coated gelatin amount of 0.01 to 1.0 g/m$^2$ between a light-sensitive silver halide emulsion layer nearest to said support and said support.

5. The silver halide photographic light-sensitive material of item 2,
wherein surface of said support is subjected to an energy treatment to produce an reactive group capable of being hardened by a hardener.

6. The silver halide photographic light-sensitive material of item 2,
wherein said light-sensitive silver halide emulsion layer contains at least a yellow coupler represented by the following Formula [Y-1], Formula [Y-1]

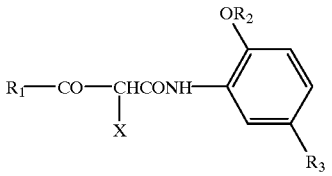

wherein $R_1$ represents an aliphatic group or an aromatic group; $R_2$ represents a nondiffisuble aliphatic or a nondiffusible aromatic group; $R_3$ represents a hydrogen atom or a hologen atom; while X represents a five or six membered nitrogen containing heterocyclic group which is released when said yellow coupler couples with an oxidized color developer.

7. The silver halide photographic light-sensitive material of item 3, wherein said silver halide photographic light-sensitive material contains at least a fluorine containing surfactant.

8. The silver halide photographic light-sensitive material of item 4, wherein a coated gelatin amount of said nonlight-sensitive hydrophilic colloidal layer coated between said light-sensitive silver halide emulsion layer nearest to said support and said support is between 0.03 to 0.8 g/m$^2$.

9. The silver halide photographic light-sensitive material of item 1, wherein said vinylsulfone group containing hardener is represented by the following Formula [H-1], Formula [H-I]

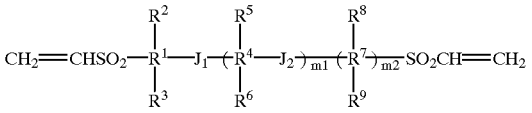

wherein $R^1$, $R^4$ and $R^7$ each represent an alkylene group and an arylene group, $R^2$, $R^3$, $R^5$, $R^6$, $R^8$ and $R^9$ each represent a hydrogen atom, an alkyl group, a hydroxyl group or a vinylsulfone group. $J_1$ and $J_2$ each represent —O—, —S—, —(C═O)—, CH(OH)—, —NHCO— or —CONH—, and m1 and m2 each represent 0 or 1.

10. The silver halide photographic light-sensitive material of item 1, wherein additional amount of said compound represented by the Formula (1) is not more than 1 g/m$^2$.

11. The silver halide photographic light-sensitive material of item 1, wherein at least one of said silver halide light-sensitive emulsion layer and said nonlight-sensitive layer contains gelatin and a coated amount of said gelatin is not more than 6.5 g/m in total.

12. The silver halide photographic light-sensitive material of item 1, wherein said silver halide light-sensitive material contains a silver halide in total amount of not more than 0.6 g/m$^2$ in terms of silver amount in said light-sensitive silver halide emulsion layer.

The present invention will be explained in detail below.

First, the vinylsulfone group containing hardener of the present invention will be explained. As the vinylsulfone group containing hardeners, for example, are cited an aromatic compound described in German Pat. No. 1,100,942, an alkyl compound bonded with a hetero atom described in Japanese Patent Examined Publication Nos. 44-29622, 47-25373, a sulfonamide and an ester type compounds described in Japanese Patent Examined Publication No. 47-8736, 1,3,5-tris(β-(vinylsulfonyl)-propionyl)-hexahydro-s-triazine described in Japanese Patent Publication Open to Public Inspection (hereinafter referred to as JP-A) No. 49-24435, or an alkyl type compound described in JP-A No. 51-44164. The photographic light-sensitive material of the present invention contains said vinylsulfone group containing hardener, but said hardener is considered to actually react with gelatin and the like contained in the photographic light-sensitive material.

Further, the compound represented by the following Formula [H-I] is preferably employed.

Formula [H-I]

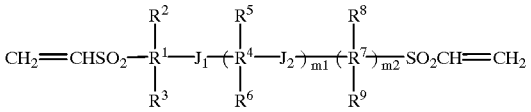

In the Formula [H-I], $R^1$, $R^4$ and $R^7$ each represent an alkylene group and an arylene group, $R^2$, $R^3$, $R^5$, $R^6$, $R^8$ and $R^9$ each represent a hydrogen atom, an alkyl group, a hydroxyl group or a vinylsulfonyl group. $J_1$ and $J_2$ each represent —O—, —S—, —(C═O)—, —CH(OH)—, —NHCO— or —CONH—, and m1 and m2 each represent 0 or 1.

Examples of alkylene groups represented by $R^1$, $R^4$ and $R^7$ include methylene group, ethylene group, propylene group and methylethylene group, etc. Examples of arylene groups include phenylene group and naphthalene group, etc.

Exemplified hardeners usable for the present invention (these are termed hardeners of the present invention) represented by the Formula [H-A] are shown below, but are not limited thereto.

H-1

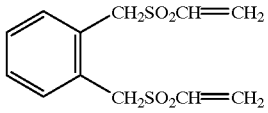

H-2

$O(CH_2CH_2SO_2CH{=}CH)_2$

H-3

$NH(CH_2CH_2SO_2CH{=}CH)_2$

H-4

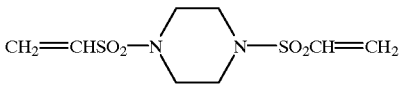

H-5

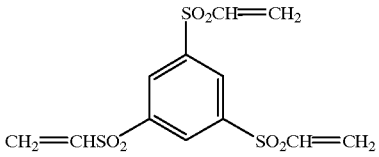

-continued

H-6

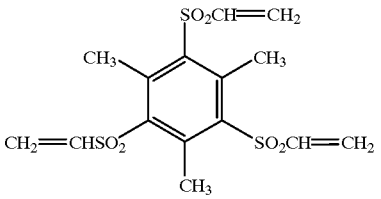

H-7

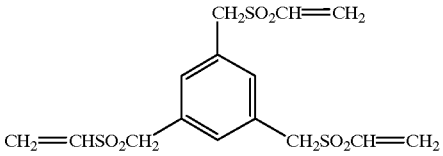

H-8

$CH_3C(CH_2OCH_2SO_2CH{=}CH_2)_3$

H-9

$C(CH_2OCH_2SO_2CH{=}CH_2)_4$

H-10

$N(CH_2CH_2OCH_2SO_2CH{=}CH_2)_3$

H-11

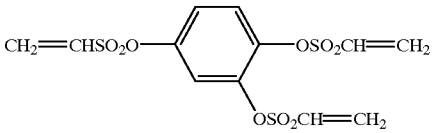

H-12

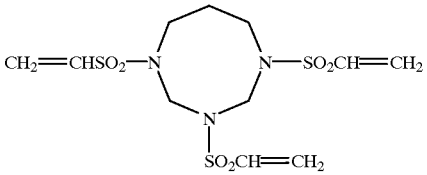

H-13

$C_2H_5C(CH_2SO_2CH{=}CH_2)_3$

H-14

$C_8H_{17}C(CH_2SO_2CH{=}CH_2)_3$

H-15

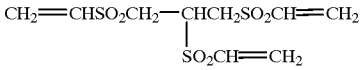

H-16

$(CH_2{=}CHSO_2CH_2)_3CCH_2Br$

H-17

$(CH_2{=}CHSO_2CH_2)_2CHCH(CH_2SO_2CH{=}CH_2)_2$

H-18

$(CH_2{=}CHSO_2CH_2)_3CCH_2OCH_2C(CH_2SO_2CH{=}CH_2)_3$

H-19

$HC(CH_2SO_2CH{=}CH_2)_3$

H-20

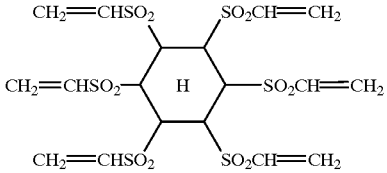

H-21

$(CH_2{=}CHSO_2CH_2)_3CCH_2SO_2CH_2CH_2Cl$

-continued

H-22

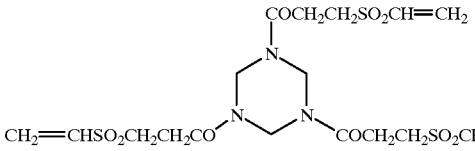

H-23

$(CH_2{=}CHSO_2CH_2)_3C{-}CH_2SO_2CH_2CH_2NHCH_2CH_2SO_3K$

H-24

$(CH_2{=}CHSO_2CH_2)_2C{-}(CH_2SO_2CH_2CH_2NHCH_2CH_2SO_3K)_2$

H-25

$CH_2{=}CHSO_2CH_2CONHCH_2CH_2NHCOCH_2SO_2CH{=}CH_2$

H-26

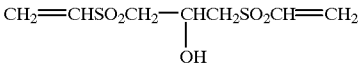

H-27

$CH_2{=}CHSO_2CH_2OCH_2SO_2CH{=}CH_2$

H-28

$CH_2{=}CHSO_2CH_2CH_2SO_2CH{=}CH_2$

H-29

$CH_2{=}CHSO_2CH_2SO_2CH{=}CH_2$

H-30

$(CH_2{=}CHSO_2)_2CHCH_2CH_2{-}C_6H_4{-}SO_3Na$ $C_6H_4$:p-phenylene

H-31

$CH_2{=}CHSO_2CH_2CH_2OCH_2CH_2SO_2CH{=}CH_2$

H-32

$CH_2{=}CHSO_2(CH_2)_4O(CH_2)_4SO_2CH{=}CH_2$

H-33

$CH_2{=}CHSO_2CH_2CH_2OCH_2CH_2OCH_2CH_2SO_2CH{=}CH_2$

H-34

$CH_2{=}CHSO_2CH_2CH_2OCH_2CH_2O(CH_2)_4SO_2CH{=}CH_2$

H-35

$CH_2{=}CHSO_2CH_2OCH_2CH_2CH_2OCH_2SO_2CH{=}CH_2$

H-36

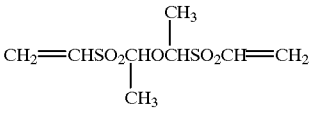

H-37

$CH_2{=}CHSO_2CH_2OCH_2CH_2SO_2CH{=}CH_2$

H-38

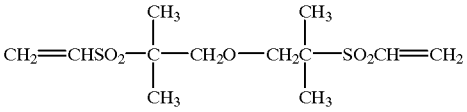

H-39

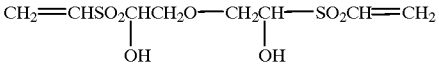

H-40

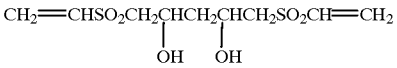

H-41

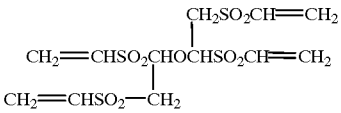

-continued

H-42

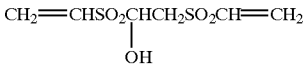

H-43

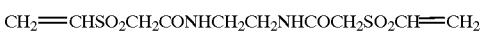

H-44

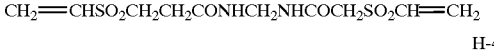

H-45

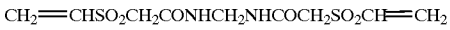

Synthesizing methods of these hardeners, for example, are described in U.S. Pat. No. 4,029,542, Japanese Patent Examined Publication Nos. 47-29622, 47-24259, 47-25373, JP-A Nos. 49-24435, 53-41221, 59-18944, etc.

The vinylsulfone group containing hardeners of the present invention include reaction products obtained by reacting the above-mentioned exemplified compounds H-5 to H-23 having at least three vinylsulfone groups with compounds having reactive groups which can react with the vinylsulfone group and a water soluble group in their molecular structures, such as diethanol amine, thioglycollic acid, sarcosine sodium salt and taurine sodium salt, etc., in addition to the above-mentioned exemplified compounds.

The hardeners of the present invention can be used singly or in combination of two or more kinds. Further, the hardeners of the present invention can be used in combination with hardeners which are not the hardeners of the present invention. Preferable hardeners used in combination with the hardeners of the present invention are chlorotriazine type hardeners (exemplified compounds II-1 to II-13, III-1 to III-10 described in JP-A No. 1-216340, pages 20 and 21) or carboxyl type hardeners described in JP-A No. 2-82237, 1-129245, etc.

An used amount of the hardeners of the present invention is between 1.0 to 1000 mg/m$^2$ to the total amount of components necessary for forming construction layers of a silver halide color photographic light-sensitive material, preferably between 10 to 500 mg. When the used amount of the hardener used in the present invention is calculated based on 1.0 g of gelatin, it is between about 0.1 to 100 mg per 1 g of gelatin, preferably between 1.0 to 50 mg. The hardener of the present invention can previously be added to a coating solution or can be added to the coating solution just prior to coating the coating solution. The hardener may be added to all of the layers consituting the photographic light-sensitive material or may be added to an arbitrary layer(s) (may be added to single layer or plural layers).

The compound of the present invention represented by the formula (1) is preferably a compound having 3 carbon atoms (n=1 in the Formula (1)) to 6 carbon atoms (n=4). The representative compounds represented by the Formula (1) are shown below, but are not limited thereto.

HC-1: ethyleneglycol
HC-2: glycerin
HC-3: erythritol
HC-4: arabitol
HC-5: xylitol
HC-6: sorbitol
HC-7: mannitol These compounds may be used singly or in combination of two or more kinds. These compounds can be added to an arbitrary layer or plural layers. Regarding an method of adding these compounds, for example, these compounds may be dissolved in water and then added, and may be added in a solid state. Additional timing of the aforesaid compound may be arbitrary during preparing a silver halide emulsion, during preparing an oil dispersion of coupler, etc., and during preparing a coating solution just prior to coating the coating solution. Additional amount of these compounds is specifically not limited, but is preferred in an amount of not more than 1 g/m$^2$.

The silver halide emulsion of the present invention may have arbitrary halogen composition such as silver chloride, silver bromide, silver chlorobromide, silver iodobromide, silver chloroiodobromide and silver chloroiodide, but preferably contains silver chloride content ratio of not less than 95%. Substantially, silver chlorobromide not containing silver iodide is preferable. In point of rapid processability and processing stability, the silver halide preferably contains the silver chloride content ratio of not less than 97 mol % and more preferably 98 to 100 mol %.

The sum total amount of the silver halide contained in the silver halide emulsion layers is preferably not more than 0.6 g/m2 in terms of silver amount.

In order to obtain the silver halide emulsion used for the present invention, a silver halide emulsion having a portion where silver bromide is contained in high density. In this occasion, the portion where silver bromide is contained in high density may be epitaxy joint with silver halide grains or may form a so-called core/shell structure. In addition, it does not form a complete layer in which regions where composition is different partially may exist. Incidentally, composition may vary continuously or uncontinuously. It is specifically preferable that the portion where silver bromide is contained in high density is the vertex of crystal grains on the surface of silver halide grains.

In order to obtain the silver halide emulsion, it is advantageous to incorporate a heavy metal ion. As a heavy metal ion capable of being used for aforesaid purpose, metals participating in 8th through 10th periodic law such as iron, iridium, platinum, palladium, nickel, rhodium, osmium, ruthenium and cobalt, transition metals participating in 12th periodic law such as cadmium, zinc and mercury and each ion of lead, rhenium, molybdenum, tungsten, gallium and chrome. Of these, metallic ions such as iron, iridium, platinum, ruthenium, gallium and osmium are preferable. Aforesaid metallic ions may be added to the silver halide emulsion in forms of salt and complex salt.

When the above-mentioned heavy metal ions form a complex salt, as its ligand or ion, cyanide ion, thiocyanate ion, isothiocyanate ion, cyanate ion, chloride ion, bromide ion, iodide ion, nitrate ion, carbonyl and ammonia are cited. Of these, a cyanide ion, thiocyanate ion, chloride ion and bromide ion are preferable.

In order to incorporate a heavy metal ion in the silver halide emulsion, aforesaid heavy metal compound may be added at an arbitrarily step including prior to forming the silver halide grains, during forming the silver halide grains and during physical ripening processing after forming the silver halide grains. In order to obtain the silver halide emulsion satisfying aforesaid conditions, a heavy metal compound may be dissolved together with a halogenated salt and may be added continuously whole through entire grain formation process or at a part thereof.

The amount of the above-mentioned heavy metal ion when being added to the silver halide emulsion is preferably $1\times10^{-9}$ mol or more to $1\times10^{-2}$ mol or less, and specifically preferably $1\times10^{-8}$ mol or more to $5\times10^{-5}$ mol or less.

The preparation of the silver halide grains used for the present invention may be arbitrary. A preferable example of shape of the silver halide grain is cubic having a crystal surface of (100). In addition, by the use of methods described in references such as U.S. Pat. Nos. 4,183,756 and 4,225,666 and JP-A No. 55-26589, Japanese Patent Examined Publication No. 55-42737 and The Journal of Photographic Science (J. Photogr. Sci.) Nos. 21 and 39 (1973), grains having forms of octahedral, tetradecahedral and dodecahedral are formed to be used. In addition, grains having twinned plane may be used.

The silver halide grains used for the present invention may be grains of a single form, but two kinds or more of mono-dispersed silver halide emulsions are specifically preferred to be used in an identical layer.

There is no limit to grain size of the silver halide grains used for the present invention. However, if considering other photographic performances such as rapid processability and speed, 0.1–1.2 $\mu$m is preferable, and 0.2–1.0 $\mu$m is more preferable.

Aforesaid grain size can be measured using projected area or diameter approximate value of the grains. If the grains are substantially uniform, the grain size distribution can be represented considerably accurately in terms of diameter or projected area.

The silver halide grains used for the present invention is preferably a mono-dispersed silver halide grains in which variation coefficient of 0.22 or less and more preferably 0.15 or less. It is specifically preferable to add two or more kinds of mono-dispersed emulsions whose variation coefficient is 0.15 or less to an identical layer. Here, variation coefficient is a coefficient representing the width of grain size distribution, and defined by the following equation.

$$\text{Variation coefficient}=S/R$$

wherein S represents a standard deviation of grain size distribution; and R represents an average grain size. Here, "grain size" means a diameter of the silver halide grains when it is spherical. When the form of grain is cubic or other than spherical, it means a diameter of a projected image when it is converted to a circle having the same area as the cubic grain or the grain of other than spherical.

As a preparation device and method of the silver halide emulsion, various conventional ones known by those skilled in the art can be used.

The silver halide emulsion used for the present invention may be any obtained by an acid method, a neutral method and an ammonia method. Aforesaid grains may be grown at one step. They may be grown after forming seed grains. How to produce seed grains and how to grow grains may be the same or different.

As a method of reacting a soluble silver salt and a soluble halogenated substance salt, any methods including a normal precipitation method, a reverse precipitation method, a double jet method and their mixture may be used. It is preferable to use the double jet method. In addition, as one type of the double jet method, a pAg controlled double jet method described in JP-A No. 54-48521 may be used. With regard to reacting device, a device disclosed in JP-A Nos. 57-92523 and 57-92524 wherein a water-soluble silver salt and an aqueous water-soluble halogenated substance salt solution are fed from an addition sub-device which is located in a reacting initial solution, a device disclosed in German Open Patent No. 2,921,164 wherein the density of a water-soluble silver salt and an aqueous water-soluble halogenated substance salt solution are continuously changed to be added and a device disclosed in JP-A No. 56-501776 wherein a reacting initial solution is taken up to outside of the reacting vessel and grains are formed while keeping distance between each silver halide grain by condensing grains by means of an ultrafiltration method may be used.

If necessary, a silver halide solvent such as thioether may be used. A compound having a mercapto group or a compound such as a nitrogen-containing compound or a sensitizing dye may be added during forming silver halide grains or after finish of forming the grains.

The silver halide emulsion according to the invention may be subjected to a sensitization method using a gold compound and a sensitization method using a charcogen sensitizer in combination.

As a charcogen sensitizer applicable to the silver halide emulsion of the present invention, a sulfur sensitizer, a selenium sensitizer and a tellurium sensitizer may be used. Of these, a sulfur sensitizer is preferable. As a sulfur sensitizer, a thiosulfate, an arylthiocarbamide, thiourea, an arylisothiacyanate, cystine, p-toluenethiosulfonic acid salt, rhodanine and inorganic sulfur are cited.

The amount of the sulfur sensitizer may be changed depending upon the kind of silver halide emulsion applied and the scale of expected effects. It is preferably $5\times10^{-10}$ to $5\times10^{-5}$ mol and more preferably $5\times10^{-8}$ to $3\times10^{-8}$ mol per mol of silver halide.

A gold sensitizer may be added as each gold complex such as chloro aurate and gold sulfide. As a ligand compound used, dimethyl rhodanine, thiocyanate, mercapto tetrazole and mercapto triazole may be cited. The additional amount of gold compound is not uniform depending upon the kind of the silver halide emulsion, the kind of compound used and ripening conditions. It is preferably $1\times10^{-4}$ to $1\times10^{-8}$ mol and more preferably $1\times10^{-5}$ to $1\times10^{-8}$ mol per mol of silver halide.

As a chemical sensitization method of the silver halide emulsion according to the present invention, a reduction sensitization method may be used.

To the silver halide emulsion, in order to prevent fogging which occurs during preparation process of the silver halide photographic light-sensitive material, to minimize performance fluctuation during storage and to prevent fogging which occurs when a light-sensitive material is developed, can be added a conventional anti-foggant and a stabilizer. As an example of a preferable compound usable for aforesaid purposes, compounds represented by Formula (II) described in JP-A No. 2-146036, on page 7, at the lower column can be cited. As more preferable compounds, compounds (IIa-1) through (IIa-8) and (IIb-1) through (IIb-7) described in aforesaid invention, on page 8 and compounds such as 1-(3-methoxyphenyl)-5-mercaptotetrazole and 1-(4-ethoxyphenyl)-5-mercaptotetrazole are cited.

Depending on their purposes, the above-mentioned compounds may be added in a preparation process, a chemical sensitization process, after aforesaid chemical sensitization process and a coating composition preparation process. When chemical sensitization is conducted in the presence of aforesaid compounds, the amount used is preferably $1\times10^{-5}$ to $5\times10^{-4}$ mol per mol of silver halide. When adding them after finish of the chemical sensitization, the amount added is preferably $1\times10^{-6}$ to $1\times10^{-2}$ mol and more preferably $1\times10^{-5}$ to $5\times10^{-3}$ mol per mol of silver halide. When adding them to the silver halide emulsion layer in the coating composition preparation process, the amount added is preferably $1\times10^{-6}$ to $1\times10^{-1}$ mol and more preferably $1\times10^{-5}$ to $1\times10^{-2}$ mol per mol of silver halide. When they are added to layers other than the silver halide emulsion layer, the amount of them in the coating layer is preferably $1\times10^{-9}$ to $1\times10^{-3}$ mol per 1 $m^2$.

To the silver halide photographic light-sensitive material used for the present invention, a dye which has absorption on various wavelength region for the purposes of anti-irradiation and anti-halation. For the purposes, any of conventional compounds can be used. As a dye having absorption in a visible region, dyes AI-1 through 11 described in JP-A 3-251840, on page 308 and dyes described in JP-A No. 6-3770 are preferably used. As an infrared absorption dye, compounds represented by Formulas (I), (II) and (III) described in JP-A No. 1-280750, on page 2, at lower left column have preferable spectral properties. They provide no adverse influence on the photographic properties of the silver halide photographic emulsion and also provide no contamination due to color residue. As practical examples preferred, can be cited compounds (1) through (45) illustrated in aforesaid specification, from page 3, lower left column to 5 page lower left column.

With regard to an amount in which aforesaid dyes are added, for the purpose of improving sharpness, an amount which causes the spectral reflective density of unprocessed sample at 680 nm is 0.7 or more is preferable, and 0.8 or more is specifically preferable.

The light-sensitive material can contain an optical brightening agent to improve back ground whiteness. As the optical brightening agent, can be cited a compound represented by the Formula II described in JP-A No. 2-232652.

As a spectral sensitizing dye used in the silver halide emulsion, any of conventional compounds can be used. As a blue sensitive sensitizing dye, compounds BS-1 through 8 described in JP-A No. 3-251840, on page 28 can be preferably used independently or mixingly in combination. As a green sensitive sensitizing dye, GS-1 through 5 described in JP-A No. 3-251840, on page 28 are preferably used. As a red sensitive sensitizing dye, RS-1 through 8 described in JP-A No. 3-251840, on page 29 are preferably used. When the light-sensitive material is exposed to infrared rays employing a semiconductor laser, it is necessary to use a red sensitive sensitizing dye, and as the red sensitive sensitizing dye, IRS-1 through 11 described in JP-A No. 4-285950 on page 6 through 8 are preferably used. It is preferable to mix aforesaid infrared, red, green and blue sensitive sensitizing dyes with super sensitizers SS-1 through SS-9 described in JP-A No. 4-285950, on page 8 and 9 or compounds S-1 through S-17 described in JP-A No. 5-66515, on page 15 through 17.

Additional timing of aforesaid sensitizing dye may be arbitrary from formation of the silver halide grains to completion of chemical sensitization.

As an additional method of the sensitizing dyes, they may be dissolved in water miscible organic solvent such as methanol, ethanol, fluorine containing alcohol, acetone and dimethylformamide or water, and added as a solution. Or, they may be added as a solid dispersant.

The present invention is characterized in that a nonlight-sensitive layer coated farthest from the support contains a betaine type surfactant. As the betaine type surfactant, are cited carboxy betaine type surfactant, sulfo betaine type surfactant and imidazolium betaine type surfactant.

The exemplified betaine type surfactants used in the present invention are shown below, but are not limited thereto.

B-1

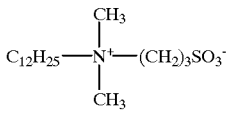

-continued

B-2

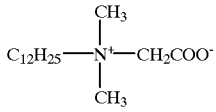

B-3

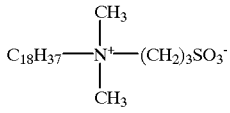

B-4

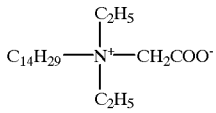

B-5

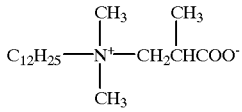

B-6

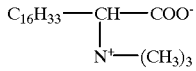

B-7

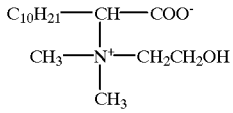

B-8

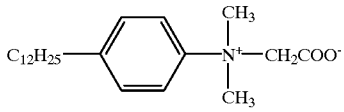

B-9

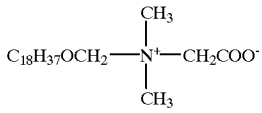

B-10

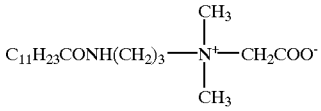

B-11

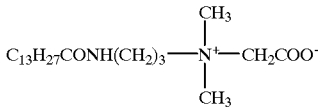

B-12

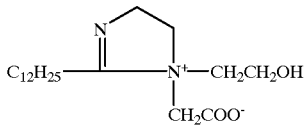

B-13

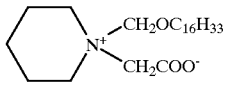

-continued

B-14

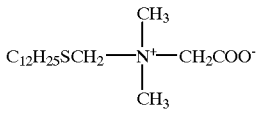

B-15

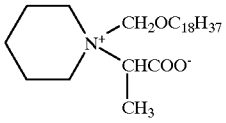

B-16

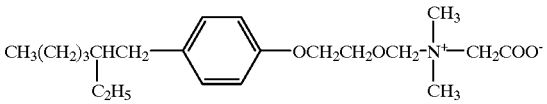

B-17

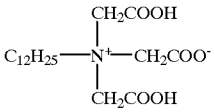

B-18

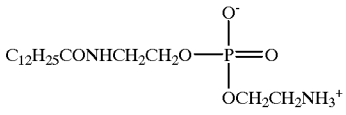

B-19

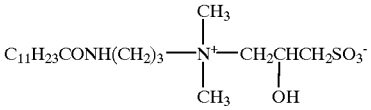

B-20

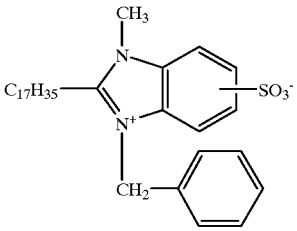

An additional amount of the betaine type surfactant is 0.0001 to 1.0 g/m$^2$ of the lightsensitive material, preferably 0.0005 to 0.5 g/m$^2$, more preferably 0.001 to 0.2 g/m$^2$. When plural layers are simultaneously coated, the betaine type surfactant is preferably contained in a layer farthest from a support and an adjacent layer to the support.

The betaine type surfactant is preferably combined with a fluorine containing surfactant to be used.

As the fluorine containing surfactant preferably used in the present invention, a compound represented by the following Formula [FA] is cited.

(Cf)-(Y)n Formula [FA]

wherein, Cf represents an n-valent group containing at least three fluorine atoms and at least two carbon atoms, Y represents —COOM, —$SO_3M$, —$OSO_3M$ or —P(=O)(OM) 21 M represents a hydrogen atom, metallic atom or ammonium group, and n represent 1 or 2.

Further, as the fluorine containing surfactant more preferably used in the present invention, a compound represented by the following Formula [FA'] is cited.

Rf-$(D)_t$-Y wherein, Rf represents a fluorine substituted alkyl group having 3 to 30 carbon atoms or an aryl group, D represents a divalent group having 1 to 12 carbon atom(s) containing at least one bonding group selected from the group consisting of —O—, —COO—, —CON($R^{11}$)— or —$SO_2$N($R^{11}$)—, $R^{11}$ represnts an alkyl group having 1 to 5 carbon atom(s), t represents 1 or 2, Y and M represent the same groups as defined in the above-mentioned Formula [FA].

Exemplified fluorine containing anionic surfactants are shown below, but are not limited thereto.

FA-1

$C_7F_{15}COONH_4$

FA-2

$C_{10}F_{21}(CH_2)_{10}COOH$

FA-3

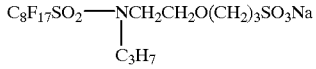

FA-4

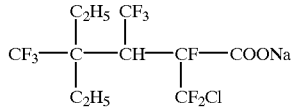

FA-5

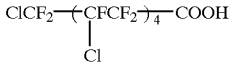

FA-6

$H(CF_2)_{10}COOH$

FA-7

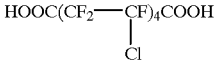

FA-8

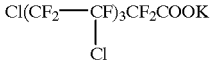

FA-9

$C_5F_{11}CH{=}CH(CH_2)_3COONa$

FA-10

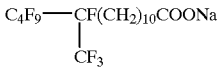

FA-11

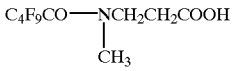

FA-12

$Cl(CF_2)_6COONa$

FA-13

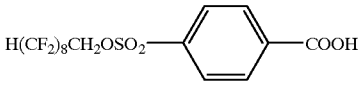

FA-14

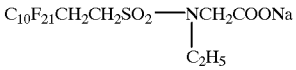

FA-15

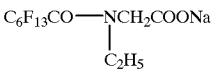

FA-16

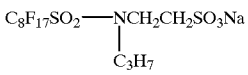

-continued

FA-17

$C_8F_{17}CO—N(C_2H_5)CH_2CH_2SO_3Na$

FA-18

$C_8F_{17}SO_2—N(C_2H_5)CH_2COONa$

FA-19

$C_8F_{17}SO_2—N(C_3H_7)CH_2COOK$

FA-20

$C_8F_{17}SO_2—N(CH_3)(CH_2CH_2O)_4(CH_2)_4SO_3Na$

FA-21

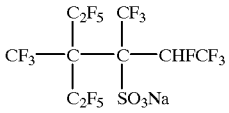

FA-22

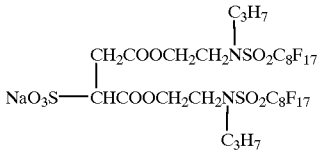

FA-23

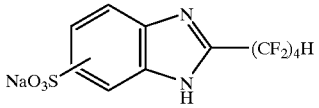

—$SO_3Na$ is located at 4- or 5-position, or mixture thereof

FA-24

$H(CF_2)_6CH_2PO_3H_2$

FA-25

$H(CF_2)_8PO_3Na_2$

FA-26

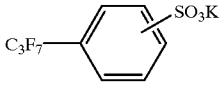

$SO_3K$ is located at o-, m- or p-position, or mixture thereof

FA-27

$C_8F_{17}SO_2—N(C_2H_5)(CH_2)_6COOK$

FA-28

$C_{12}H_{25}CH_2OSO_3Na$

FA-29

$C_7F_{15}COO(CH_2)_3SO_3K$

FA-30

$NaO_3S—CH(CH_2COOCH_2(CF_2)_6H)COOCH_2(CF_2)_6H$

FA-31

$C_{16}H_{33}—CH(SO_3Na)COOCH_2CF_3$

FA-32

$(CF_3)_2CFO(CF_2)_2CH_2—CH(CH_2)_6COONa$ $(CF_3)_2CFO(CF_2)_2CH_2—CH(CH_2)_6COONa$

-continued

FA-33

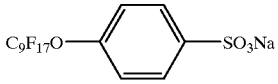

FA-34

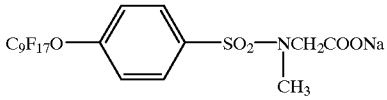

FA-35

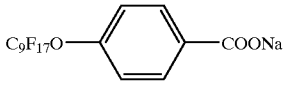

FA-36

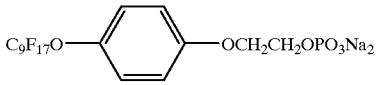

FA-37

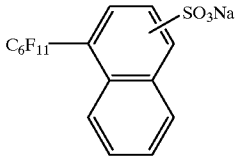

FA-38

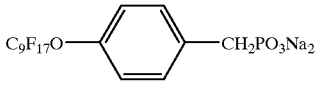

FA-39

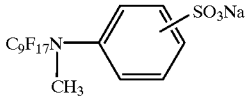

FA-40

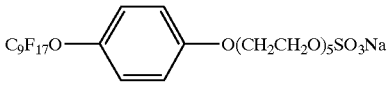

FA-41

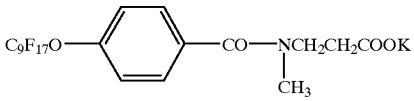

FA-42

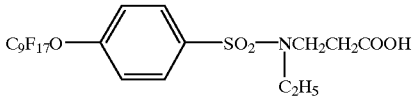

FA-43

$C_9F_{17}OCH_2CH_2OSO_3Na$

FA-44

$C_9F_{17}O(CH_2)_4OPO_3Na_2$

FA-45

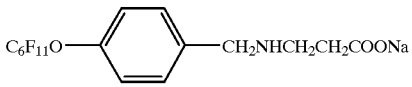

FA-46

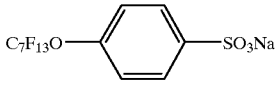

FA-47

$H(CF_2)_7O(CH_2)_3SO_3Na$

-continued

FA-48

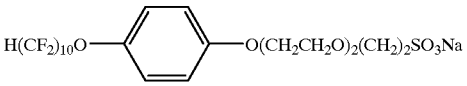

FA-49

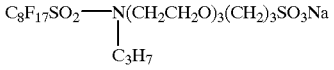

The fluorine containing surfactant containing at least one bonding group consisting of $—SO_2N(R^{11})—$ is specifically preferred to be used.

A nitrogen containing cationic surfactant used in the present invention is a compound represented by the following Formula [FK].

$$R'f–G–J^+L^- \qquad \text{Formula [FK]}$$

wherein, R'f represents a hydrocarbon group having 1 to 20 carbon atom(s), and at least one hydrogen atom of said hydrocarbon group is substituted with a fluorine atom, G represents a chemical bonding group or a divalent group, $J^+$ represents a cationic group and $L^-$ represents a counter anion.

Examples of R'f include $—C_kF_{2k-1}$ (K=1 to 20, preferably 3 to 12), $—C_qHF_{2q}$, $—C_qF_{2q+1}$ (q=2 to 20, preferably 3 to 12), and examples of G include $—SO_2N(R^{21})(CH_2)_p—$, $—CON(R^{21})(CH_2)_p—$, $—OASO_2N(R^{21})(CH_2)_p$, $—OACON(R^{21})(CH_2)_p—$, $—OAO(CH_2)_p—$, $—OA(CH_2)_p—$, $—O(CH_2CH_2O)_q(CH_2)_p—$, $—O(CH_2)_p—$, $—N(R^{21})(CH_2)_p—$, $—SO_2N(R^{21})(CH_2)_pO(CH_2)_r—$, $—CON(R^{21})(CH_2)_pO(CH_2)_r—$, $—OASO_2N(R^{21})(CHR^{21})_pOA—$, $—(CH_2)_p(CHOH)_s(CH_2)_r—$, etc., wherein $R^{21}$ represents a hydrogen atom or an alkyl group having 1 to 6 carbon atom(s) (including a substituted alkyl group); A represents an alkylene group, an arylene group; p, r and s are each 0 to 6; and q is 2 to 20.

Examples of $J^+$ include $—N^+(R^{21})_3$, $—N^+(CH_2CH_2OCH_3)_3$, $N^+C_4H_8O(R^{21})$, $—N^+(R^{21})(R^{22})(CH_2CH_2OCH_3)$, $—N^+C_5H_5$, $—N^+(R^{21})(R^{22})(CH_2)_pC_6H_5$, $—N^+(R^{21})(R^{22})(R^{23})$, etc., wherein $R^{22}$ and $R^{23}$ each represent the same examples as defined for the above-mentioned $R^{21}$.

Furthermore, examples of $L^-$ include $I^-$, $Cl^-$, $Br^-$, $CH_3SO_3^-$ and $CH_3—C_6H_4—SO_3^-$, etc.

Exemplified compounds of the fluorine containing cationic surfactant are shown below, but are not limited thereto.

FK-1

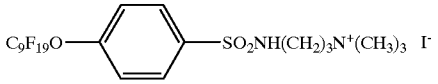

FK-2

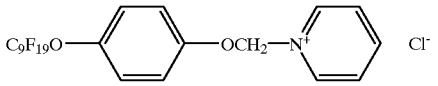

FK-3

$C_7F_{15}CONH(CH_2)_2N^+(CH_3)_3$ $Cl^-$

FK-4

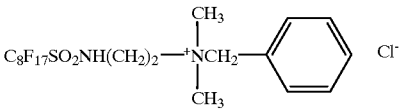

FK-5

$C_2F_5CONH(CH_2)_3N^+(CH_3)_3$ $I^-$

FK-6

$C_{12}F_{23}O(CH_2CH_2O)_5CH_2CH_2N^+(CH_3)_3$ $I^-$

FK-7

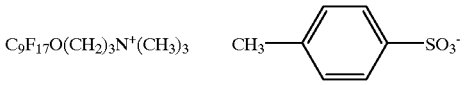

FK-8

$C_8F_{17}SO_2NH(CH_2)_3N^+(CH_3)_3$ $I^-$

FK-9

$C_8F_{17}SO_2NH(CH_2)_3N^+(CH_2CH_2OCH_3)_3$ $I^-$

FK-10

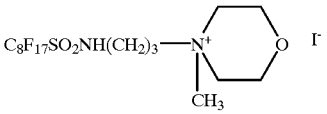

-continued

FK-11

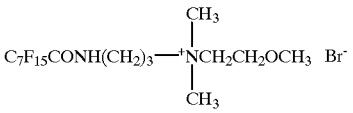

FK-12

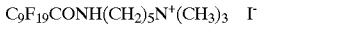

FK-13

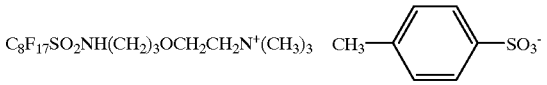

FK-14

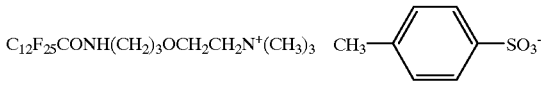

FK-15

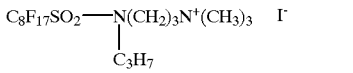

FK-16

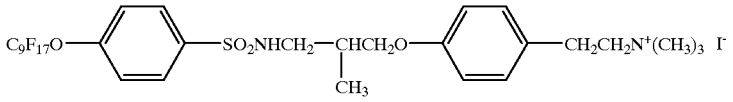

FK-17

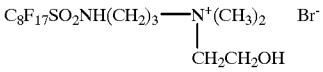

FK-18

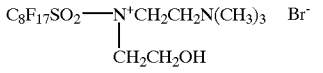

FK-19

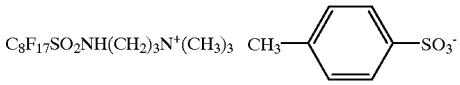

FK-20

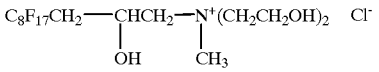

FK-21

In the present invention, it is specifically preferable to use a water insoluble fluorine containing cationic surfactant having at least one bonding group consisting of —$SO_2N(R_{21})$—. Herein, "water insoluble" means that, 2.0 g of a surfactant is added to 100 m1 of deionized water at 23° C. and the thus obtained solution is stirred for 1 hour and then allowed to stand at 23° C. for 24 hours, after that precipitating matter and floating matter are visually observed. For example, FK-1, FK-8, FA-15 and FK-16 are applicable to the "water insoluble" compounds, but the "water insoluble" compound is not limited to these compounds and can be selected according to the above-mentioned method.

Of these, the fluorine containing cationic surfactants having trade names such as Megafac F (produced by Dainihon Ink Chemical Industry Co., Ltd.), Fluorad FC (produced by 3M Co., Ltd.), Monflor (produced by ICI Co., Ltd.), Zonyls (produced by E.I. Dupont Co., Ltd.) and Licowet VPF (produced by Hoechst Co., Ltd) are in the market.

In the present invention, combined usage of the fluorine containing cationic surfactant and the fluorine containing anionic surfactant is specifically preferable.

Total used amount of the fluorine containing cationic surfactant and the fluorine containing anionic surfactant is 0.0001 to 1.0 g/$m^2$, preferably 0.0005 to 0.3 g/$m^2$, more preferably 0.001 to 0.15 g/$m^2$.

Two or more kinds of the fluorine containing cationic surfactants and fluorine containing anionic surfactants can be used in combined usage. In said combined usage, molar ratio of the fluorine containing cationic surfactant to the fluorine containing anionic surfactant is preferably 1:10 to 10:1, more preferably 3:7 to 7:3.

The present invention is characterized in that the light-sensitive material of the present invention comprises at least a nonlight-sensitive hydrophilic colloidal layer in a coated gelatin amount of 0.01 to 1.0 g/$m^2$ between a silver halide light-sensitive emulsion layer nearest to a support and said support. Total gelatin content of said nonlight-sensitive hydrophilic colloidal layer is preferably 0.03 to 0.8 g per 1 $m^2$ of the light-sensitive material, more preferably 0.04 to 0.6 g/$m^2$. Said nonlight-sensitive hydrophilic colloidal layer may contain latex, oil, titanium oxide, barium sulfate, calcium carbonate, colloidal silver and optical brightening agent, etc.

As a support used for the silver halide photographic light-sensitive material of the present invention, any materials can be used. Paper laminated with polyethylene (PE) and polyethylene terephthalate (PET), paper support comprises natural pulp or synthetic pulp, a vinyl chloride sheet, propylene which may contain a white pigment, PET support and a baryta paper can be used. Of these, a support having a water-proof resin laminated layer on both base paper is preferable. As a water-proof resin, PE, PET or their copolymer are preferable.

In addition, the present invention is characterized in that surface of a support is subjected to an energy treatment to produce an reactive group capable of being hardened by a hardener on its surface.

As an energy treatment, can be cited grow discharge, plasma treatment and burner heating treatment, etc. described in JP-A Nos. 9-197618, 9-258376, 10-20443, European Patent No. 785,466.

As a white pigment used for a support, an inorganic and/or organic white pigment may be used. The preferable is an inorganic white pigment. For example, sulfates of an alkaline earth metal such as barium sulfate, carbonate of an alkaline earth metal such as calcium carbonate, silicas such as fine powder silicate and synthetic silicate salt, calcium silicate, alumina, alumina hydrate, titanium oxide, zinc oxide, talc and clay are used. The preferable white pigments are barium sulfate and titanium oxide.

The amount of white pigment contained in a water-proof resin layer on the surface of a support is preferably 13 wt % or more, more preferably 15 wt % or more of whole resin layer, from the viewpoint of improving sharpness.

The degree of dispersion of the white pigment in a water-proof resin layer in paper support of the present invention can be measured by a method described in JP-A No. 2-28640. When measured by means of aforesaid method, the degree of dispersion of white pigment is preferably 0.20 or less and more preferably 0.15 or less in terms of variation coefficient described in aforesaid specification.

In addition, in order to regulate spectral reflective density balance on the white background after being processed and to improve white background, it is preferable to add minute amount of blue-tinting agent or red-tinting agent such as ultramarine blue or an oil-soluble dye in a white pigment containing water-proof resin in the reflective support or in a hydrophilic colloidal layer coated.

As a coupler, any compounds forming coupling product having maximum absorption wave length of 340 nm or more upon reaction with oxidation product of color developing agent are employed. Typically representative compounds are those known as a yellow dye forming coupler having a spectral absorption maximum wavelength on wavelength range of 350–500 nm, those known as a magenta dye forming coupler having a spectral absorption maximum wavelength on wavelength range of 500–600 nm and those known as a cyan dye forming coupler having a spectral absorption maximum wavelength on wavelength region of 600–750 nm.

As a cyan coupler preferably used for the silver halide photographic light-sensitive material of the present invention, couplers represented by Formulas (C-I) and (C-II) described in JP-A No. 4-114154, on page 5 at lower left column. Practical compounds include CC-1 through CC-9 described in aforesaid specification, from page 5 lower right column to page 6 lower left column.

As a magenta coupler preferably used for the silver halide photographic light-sensitive material of the present invention, couplers represented by Formulas (M-I) and (M-II) described in JP-A No. 4-114154. Practically, MC-1 to MC-11 described in aforesaid specification on page 4, lower left column to page 5 upper right column are cited. Of the above-mentioned magenta couplers, the more preferable ones are couplers represented by Formula (M-I) in aforesaid specification, on page 4, upper right column. Further of these, couplers in which $R_M$ of the above-mentioned Formula (M-I) is a tertiary alkyl group is specifically preferable since they are excellent in terms of light fastness. MC-8 through MC-11 described in aforesaid specification, page 5, upper column are excellent in terms of color reproducibility from blue to violet and red, and also excellent in terms of detailed drawing ability.

As a yellow coupler preferably used for the silver halide photographic light-sensitive material of the present invention, couplers represented by the Formula (Y-I) described in JP-A No. 4-114154. Practically, YC-1 to YC-9 described in aforesaid specification on page 3, lower left column and thereafter are cited. Of the above-mentioned yellow couplers, the more preferable ones are couplers represented by the Formula [Y-1] having alkoxy group as $R_{Y1}$, and couplers represented by the Formula [I] of JP-A No. 6-67388 in view of reproduction of preferable yellow tone. Further of these, couplers YC-8 and YC-9 described in JP-A No. 4-114154, page 4, lower left column and Couplers No. (1) to (47) described in JP-A No. 6-67388, pages 13 and 14 are cited as excellent examples. The most preferable compounds are those represented by Formula [Y-1] described on pages 1 and 11 to 17 of JP-A No. 4-81847. However, a yellow coupler represented by the following Formula [Y-I] is preferably employed in the present invention.

Formula [Y-I]

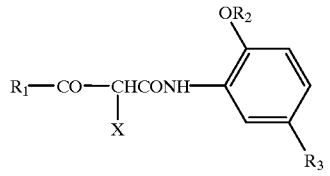

wherein $R_1$ represents an aliphatic group or an aromatic group; $R_2$ represents a nondiffisuble aliphatic or a nondiffusible aromatic group; $R_3$ represents a hydrogen atom or a hologen atom; while X represents a five or six membered nitrogen containing heterocyclic group which is released when said yellow coupler couples with an oxidized color developer.

In the Formula [Y-I], examples of the aliphatic group represented by $R_1$ include a straight chain, branched chain or cyclic alkyl group such as methyl, ethyl, i-propyl, t-butyl, cyclopropyl, cyclohexyl, adamantyl, dodecyl, 1-hexylnonyl, etc. These alkyl groups can contain a substituent group and examples of the substituent group include a halogen atom (chlorine, bromine, etc.), an aryl group (phenyl group, p-t-octylphenyl group, etc.), an alkoxy group (methoxy group, butoxy group, etc.), an aryloxy group (2,4-di-t-amylphenoxy group, etc.), a sulfonyl group (mathanesulfonyl group, benzenesulfonyl group, etc.), an acylamino group (acetoamide group, benzamide group, etc.), a sulfonylamino group (dodecanesulfonylamino group, etc.) and a hydroxyl group.

Example s of the aromatic group represented by $R_1$ include an aryl group having 6 to 14 carbon atoms (phenyl group, 1-naphthyl group, 9-anthranyl group, etc.). These aryl groups can contain a substituent group. Examples of the substituent group include a nitro group, a cyano group, an amino group (dimethylamino group, anilino group, etc.), an alkylthio group (methythio group, etc.), the same groups as defined for the alkyl group represented by the above-mentioned $R_1$, or the same substituent groups as defined for the substituent groups for the alkyl group represented by the above-mentioned $R_1$.

$R_1$ is preferably alkyl group, more preferably branched alkyl group, most preferably t-butyl group.

Examples of the nondiffisuble aliphatic group represented by $R_2$ include preferably straight chain, branched chain or cyclic alkyl group such as 2,6-dimethylcyclohexyl, 2-ethylhexyl, i-tridecyl, hexadecyl or octadecyl group, etc. The nondiffisuble alkyl group represented by $R_2$ may be a group having a functional group in its molecular structure represented by the following Formula [II].

$-J-L-R_{12}$ Formula [III]

wherein, J represents a straight or a branched alkylene group having 1 to 20 carbon atom(s) and examples of the alkylene group include methylene group, 1,2-ethylene group, 1,1-dimethylmethylene group, 1-decylmethylene group, etc., $R_{12}$ represents a straight or a branched alkyl group having 1 to 20 carbon atom(s), for example, $R_{12}$ represents the same alkyl group as defined for $R_1$ in the Formula [Y-I]. L represents chemical bond such as —O—, —OCO—, —$OSO_2$—, —CO—, —COO—, —CON($R_{13}$)—, —CON($R_{13}$)$SO_2$—, —N($R_{13}$)—, —N($R_{13}$)CO—, —N($R_{13}$)$SO_2$—, —N($R_{13}$)CON($R_{14}$)—, —N($R_{13}$)COO—, —S(O)$_a$—, —S(O)$_a$N($R_{13}$)— or —S(O)$_a$N($R_{13}$)CO—. $R_{13}$ and $R_{14}$ each represent a hydrogen atom or the same alkyl group and aryl group as defined for those represented by $R_1$ in the above-mentioned Formula [Y-1]. a represents an integer of 0 to 2. $R_{12}$ and J may bond with each other to form a ring structure.

The alkyl group represented by $R_{12}$ can further contain a substituent group and the substituent group represents the same substituent group as defined as the substituent group for the alkyl group represented by $R_1$ in the Formula [Y-1]

Examples of the nondiffisuble aromatic group represented by $R_2$ in the above-mentioned Formula [Y-1] include the same aryl group as defined as the aryl group represented by the above-mentioned $R_1$. The aryl group represented by $R_2$ can contain a substituent and examples of the substituent include the same substituent as defined for the substituent for the aryl group represented by the above-mentioned $R_1$.

The preferable substituent for the aryl group represented by $R_2$ is a straight or branched alkyl group having 4 to 10 carbon atoms. The above-mentioned $R_2$ is preferably a nondiffusible aromatic group.

$R_3$ in the Formula [Y-I] represents a hydrogen atom or a halogen atom, and examples of the halogen atom include chlorine or bromine. Preferable one is chlorine.

X represents a nitrogen containing heterocyclic group which is released when a yellow coupler represented by the Formula [Y-I] couples with an oxidized color developer. X is represented by the following Formula [III].

Formula [III]

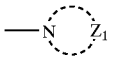

wherein, $Z_1$ represents a nonmetallic atom group necessary to form a 5 or 6 membered heterocyclic ring together with a nitrogen atom. Herein, as a atom group necessary to form said nonmetallic atom group, for example, are cited a substituted and an unsubstituted methylene, a substituted and an unsubstituted methine, >C=O, >N—$R_{15}$ ($R_{15}$ represents a hydrogen atom, an alkyl group, a cycloalkyl group, an aryl group or a heterocyclic group), —N=, —O—, and —S(O)$_b$ (b is an integer of 0 to 2).

Said nitrogen containing heterocyclic group X represented by the above-mentioned Formula [III] is preferably represented by the following Formulas [IV], [V], [VI], [VII], [VIII] or [IX].

Formula [IV]

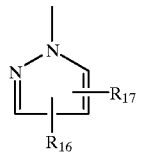

Formula [V]

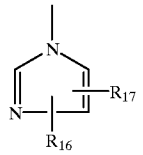

Formula [VI]

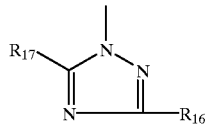

Formula [VII]

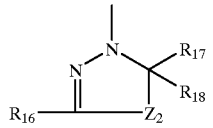

Formula [VIII]

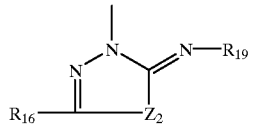

Formula [IX]

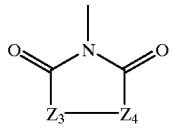

In the above-mentioned Formulas [IV], [V], [VI], [VII] or [VIII]I, $R_{16}$, $R_{17}$ and $R_{18}$ each represent a group capable of substituting on a nitrogen containing heterocyclic ring, and examples of the group capable of substituting on the nitrogen containing heterocyclic ring include the same substituents as defined for the substituents for the alkyl group, the cyclocalkyl group and the aryl group represented by $R_1$ in the above-mentioned Formula [Y-I].

In the Formula [VIII], $R_{19}$ represents the same group as defined for the groups of the alkyl, the cycloalkyl and the aryl represented by $R_1$ in the Formula [Y-I], additionally a carbonyl group (alkyl carbonyl group such as acetyl, trifluoroacetylpivaloyl, etc. and aryl carbonyl group such as benzoyl, pentafluorobenzoyl, 3,5-di-t-butyl-4-hydroxybenzoyl, etc.) and a sulfonyl group (alkyl sulfonyl group such as mathane sulfonyl group, trifluoromethane sulfonyl group, etc. and aryl sulfonyl group such as p-toluene sulfonyl gruop, etc.).

In the Formulas [VII] and [VIII], $Z_2$ represnts >N—$R_{20}$ ($R_{20}$ represents the same group as defined for $R_{15}$ of the group $Z_1$ in the above-mentioned Formula [III]), —O— or —$S(O)_k$— (k is an integer of 0 to 2).

In the Formula [IX], $Z_3$ represnts >N—$R_{21}$ ($R_{21}$ represents the same group as defined for $R_{15}$ of the group $Z_1$ in the above-mentioned Formula [III]), or —O—. $Z_4$ represnts >N—$R_{22}$ ($R_{22}$ represents the same group as defined for $R_{15}$ of the group $Z_1$ in the above-mentioned Formula [III]), or >$C(R_{23})(R_{24})$ ($R_{23}$ and $R_{24}$ each represent a hydrogen atom or the same substituent group as defined for the substituent group for alkyl group, cycloalkyl group and aryl group represented by $R_1$ in the Formula [Y-I].

As the nitogen containing heterocyclic group X represented by the above-mentioned Formula [III] included in the Formula [Y-I], the group represented by the above-mentioned Formula [IX] is specifically preferable.

At least two two-equivalent yellow couplers represented by the Formula [Y-I] of the present invention may bond with each other at some portions of the substituents in their molecular structures to form a bis type, tris type, tetrakis type or polymer type yellow coupler.

Exemplified two equivalent yellow couplers represented by the Formula [Y-I] are shown below, but are not limited thereto.

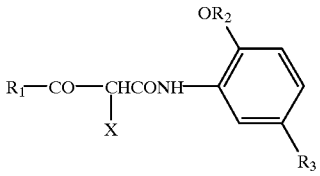

| No. | $R_1$ | $R_2$ | $R_3$ | X |
|---|---|---|---|---|
| (1) | $(CH_3)_3C$— | —$C_{18}H_{37}$ | H | 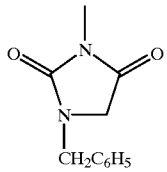 |
| (2) | $(CH_3)_3C$— | —$C_{18}H_{37}$ | H | 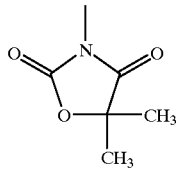 |
| (3) | $(CH_3)_3C$— | —$C_{16}H_{33}$ | H | 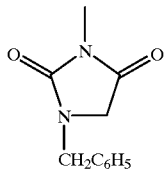 |
| (4) | $(CH_3)_3C$— | —$C_{16}H_{33}$ | H | 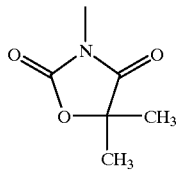 |
| (5) | $(CH_3)_3C$— | —$C_{16}H_{33}$ | H | 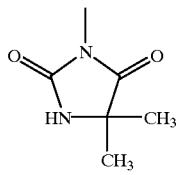 |

-continued
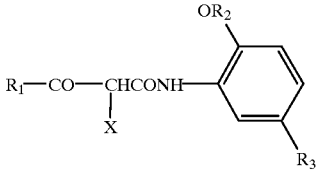
| No. | $R_1$ | $R_2$ | $R_3$ | X |
|---|---|---|---|---|
| (6) | $(CH_3)_3C$— | —$C_{14}H_{29}$ | H | 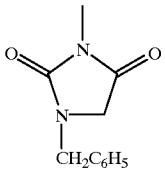 |
| (7) | $(CH_3)_3C$— | —$C_{14}H_{29}$ | H | 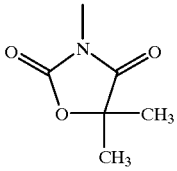 |
| (8) | $(CH_3)_3C$— | —$C_{12}H_{25}$ | H | 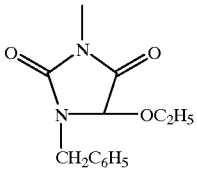 |
| (9) | $(CH_3)_3C$— | —$CH_2CO_2C_{12}H_{25}$ | H | 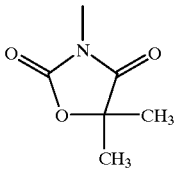 |
| (10) | $(CH_3)_3C$— | —$CHCO_2C_{12}H_{25}$ (with $C_4H_9$) | H | 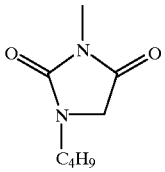 |
| (11) | $(CH_3)_3C$— | 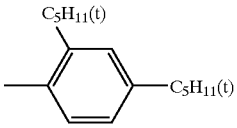 | H | 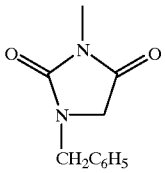 |
| (12) | $(CH_3)_3C$— | 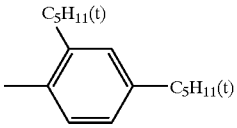 | H | 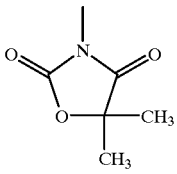 |

-continued
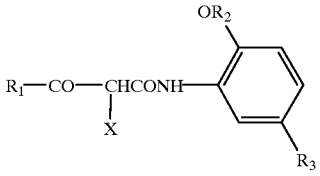
| No. | $R_1$ | $R_2$ | $R_3$ | X |
|---|---|---|---|---|
| (13) | $(CH_3)_3C$— | 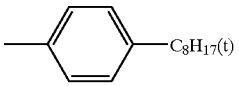 | H | 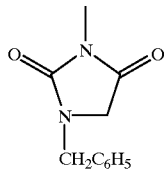 |
| (14) | $(CH_3)_3C$— | 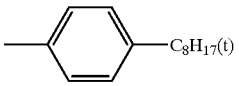 | H | 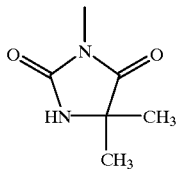 |
| (15) | $(CH_3)_3C$— | 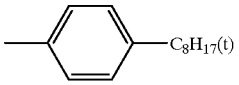 | H | 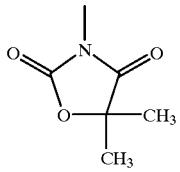 |
| (16) | $(CH_3)_3C$— | 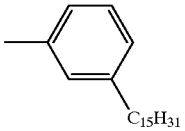 | H | 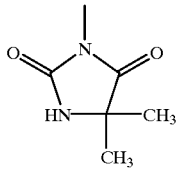 |
| (17) | $(CH_3)_3C$— | 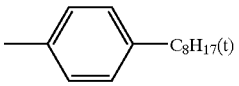 | H | 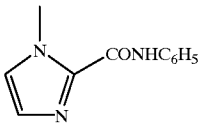 |
| (18) | $(CH_3)_3C$— | —$C_{18}H_{37}$ | Cl | 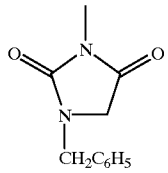 |
| (19) | $(CH_3)_3C$— | —$C_{18}H_{37}$ | Cl | 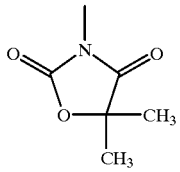 |

-continued
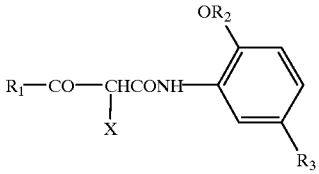
| No. | $R_1$ | $R_2$ | $R_3$ | X |
|---|---|---|---|---|
| (20) | $(CH_3)_3C$— | —$C_{15}H_{33}$ | Cl | 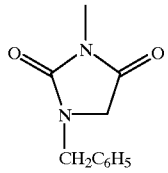 |
| (21) | $(CH_3)_3C$— | —$C_{16}H_{33}$ | Cl | 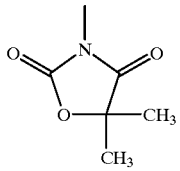 |
| (22) | $(CH_3)_3C$— | —$C_{14}H_{29}$ | Cl | 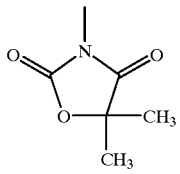 |
| (23) | $(CH_3)_3C$— | —$C_{14}H_{29}$ | Cl | 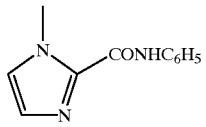 |
| (24) | $(CH_3)_3C$— | —$C_{14}H_{29}$ | Cl | 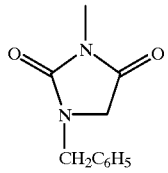 |
| (25) | $(CH_3)_3C$— | —$C_{12}H_{25}$ | Cl | 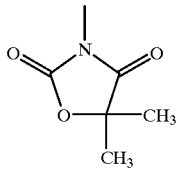 |
| (26) | $(CH_3)_3C$— | —$C_{12}H_{25}$ | Cl | 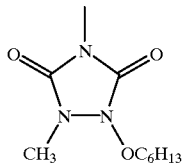 |

-continued
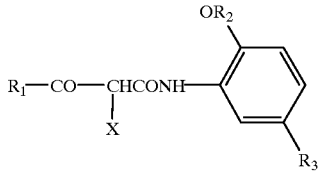
| No. | $R_1$ | $R_2$ | $R_3$ | X |
|---|---|---|---|---|
| (27) | $(CH_3)_3C$— | —$CH_2CO_2C_{14}H_{29}$ | Cl | 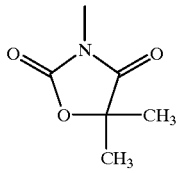 |
| (28) | $(CH_3)_3C$— | —$CH_2CON(C_8H_{17}\text{-t})_2$ | Cl | 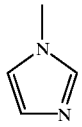 |
| (29) | $(CH_3)_3C$— | 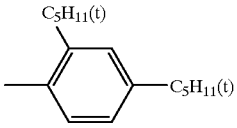 | Cl | 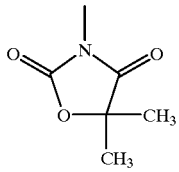 |
| (30) | $(CH_3)_3C$— | 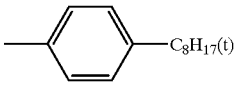 | Cl | 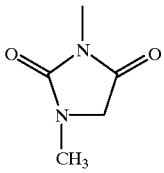 |
| (31) | 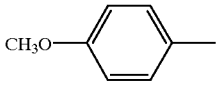 | —$C_{18}H_{37}$ | Cl | 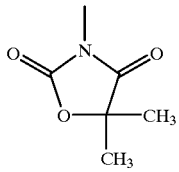 |
| (32) | 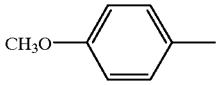 | —$C_{16}H_{33}$ | Cl | 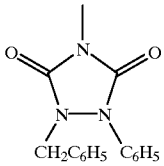 |
| (33) | 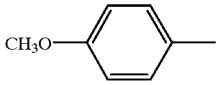 | —$CH_2CO_2C_{12}H_{25}$ | Cl | 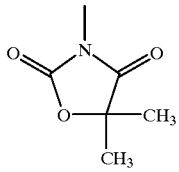 |

-continued
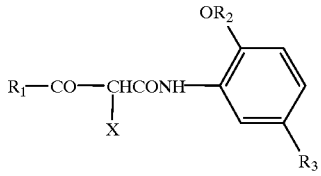
| No. | $R_1$ | $R_2$ | $R_3$ | X |
|---|---|---|---|---|
| (34) | 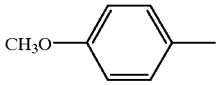 | 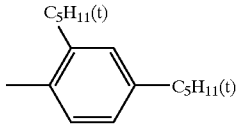 | Cl | 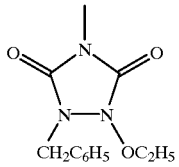 |
| (35) | 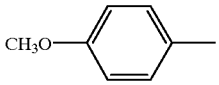 | 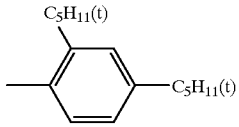 | Cl | 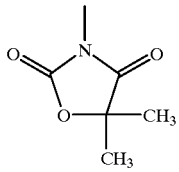 |
| (36) | 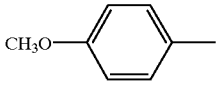 | 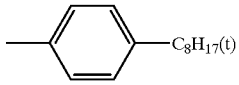 | H | 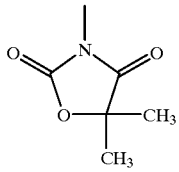 |
| (37) | 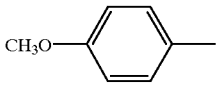 | 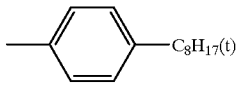 | H | 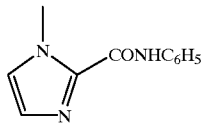 |
| (38) | 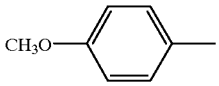 | 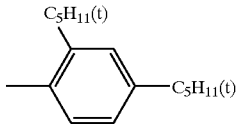 | Cl | 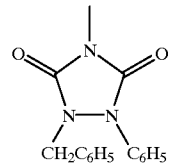 |
| (39) | 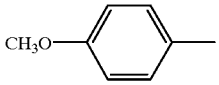 | 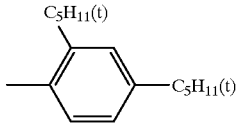 | Cl | 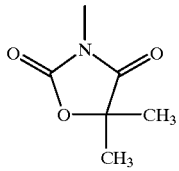 |
| (40) | 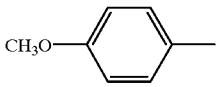 | 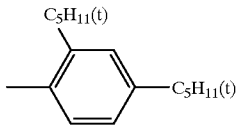 | Cl | 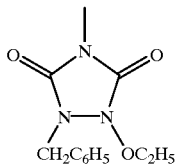 |

-continued

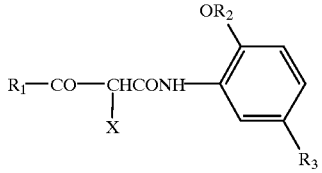

| No. | $R_1$ | $R_2$ | $R_3$ | X |
|---|---|---|---|---|
| (41) | 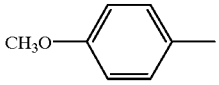 | 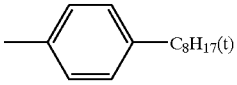 | Cl | 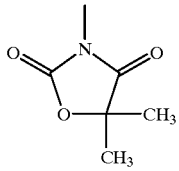 |
| (42) | 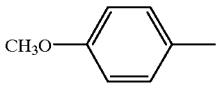 | 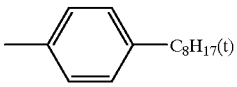 | Cl | 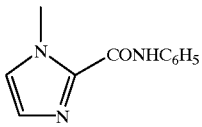 |
| (43) | 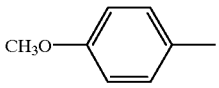 | 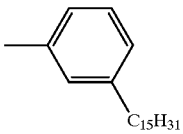 | Cl | 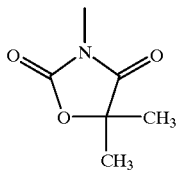 |
| (44) | 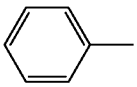 | 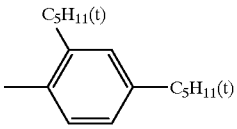 | H | 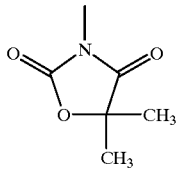 |

These couplers can be easily synthesized according to known methods.

In case that a method of dispersion of oil in water emulsifying process of adding organic compounds such as the coupler and the organic compounds is employed, they are dissolved in a water insoluble organic solvent having high boiling point, usually not more than 150° C., using, if necessary, low boiling point and/or water soluble organic solvent, and then, dispersed in hydrophilic binder such as gelatin solution with the aid of surfactant. A mixer, a homogenizer, a colloid mill, a flow jet mixer, a ultra sonic dispersion apparatus or so may be used as a dispersion means. A process of removing low boiling point organic solvent may be applied during or after the dispersion process. The preferable example of the high boiling point organic solvent dissolving the coupler used for the dispersing includes phthalic acid ester compounds such as dioctyl phthalate, di-i-decyl phthalate and dibutyl phthalate, phosphoric acid ester compounds such as tricresyl phosphate or trioctyl phosphate. Dielectric constant of the high boiling point organic solvent is preferably 3.5 to 7.0. Two or more high boiling point organic solvents may be used in combination.

A polymer compound insoluble in water and soluble in organic solvent may be used for dispersing the organic compound in place of using the high boiling point organic solvent, or by using in combination with the high boiling point organic solvent. The polymer compound is dispersed with the organic compound in hydrophilic binder such as gelatin solution with the aid of surfactant. An example of the polymer includes poly(N-t-butylacrylamide).

As a preferable surfactant used for regulating surface tension when photographic additives are dispersed or coated, can be cited one containing hydrophobic group having 8 to 30 carbon atoms and a sulfonic acid group in its molecule and its salt. Practically, A-1 to A-11 described in JP-A No. 64-26854 are cited. In addition, surfactants in which an alkyl group contains at least a fluorine atom are also preferably used. Aforesaid dispersed composition are ordinarily added to a coating composition containing a silver halide emulsion. Time until they are added to the coating composition after being dispersed and time from they are added to the coating composition to coating are the shorter the better. They are respectively within 10 hours. Within 3 hours and within 20 minutes are more preferable.

It is preferable to use an anti-color fading agent in combination with each of the above-mentioned couplers in order to prevent color fading of dye image due to light, heat and humidity. As a preferable compound for a magenta dye use, phenyl-ether-containing compounds represented by Formulas I and II described in JP-A No. 2-66541, on page 3, phenol-containing compounds represented by Formula IIIB described in JP-A No. 3-174150, amine-containing compounds represented by Formula A in JP-A No. 64-90445 and metal complex represented by Formula XII, XIII, XIV and XV described in JP-A 62-182741 are preferable. As preferable compounds for a yellow dye and a cyan dye, compounds represented by I' described in JP-A 1-196049, and compounds represented by Formula II described in JP-A 5-11417 are preferable.

In order to shift absorption wavelength of a coloring dye, a compound (d-11) described in JP-A No. 4-114154, page 9, on lower left column and compound (A'-1) described in aforesaid specification, on page 10, on a lower left column can be used. Other than above, fluorescent dye releasing compounds described in U.S. Pat. No. 4,774,187 can be used.

With regard to the silver halide light-sensitive material, it is preferable to minimize color stain by adding a compound which reacts with a developing agent oxidized product and adding between a light-sensitive layer and another light-sensitive layer. As a compound used for aforesaid purpose, hydroquinone derivatives are preferable. More preferably, dialkyl hydroquinone such as 2,5-di-t-octyl hydroquinone is preferable. More specifically, compounds represented by Formula II described in JP-A No. 4-133056 are cited, and compounds II-1 through II-14 described in aforesaid specification, on pages 13 to 14 and compound 1 described on page 17 are cited.

It is also preferable to add a UV absorber to the light-sensitive material of the present invention, in order to minimize static fogging and improve light-fastness of a dye image. Preferable UV rays absorbers include benzotriazoles. The specifically preferable compounds include compounds represented by Formula III-3 described in JP-A No. 1-250944, compounds represented by Formula III described in JP-A No. 64-66646, UV-1L to UV-27L described in JP-A No. 63-187240, compounds represented by Formula I described in JP-A No. 4-1633 and compounds represented by Formulas (I) and (II) described in JP-A No. 5-165144.

It is advantageous to use gelatin as a binder in the silver halide photographic light-sensitive material. As necessary, other gelatins, gelatin derivatives, graft polymer between gelatin and another polymer, protein other than gelatin, sugar derivatives, cellulose derivatives and hydrophilic colloid such as synthetic hydrophilic polymer such as a monomer or a copolymer may be used.

Total gelatin content contained in the photographic light-sensitive material of the present invention is preferably not more than 6.5 $g/m^2$.

In order to prevent propagation of mildews and bacteria which adversely influence photographic performance and image storage stability, it is preferable to incorporate anti-mildew agent and an antiseptics as described in JP-A No. 3-157646. In order to improve the surface property of the silver halide light sensitive material or processed sample, it is preferable to add a lubricant described in JP-A Nos. 6-118543 and 2-73250 in the protective layer.

When coating a photographic light-sensitive material employing a silver halide emulsion, a thickening agent may be used for improving coating properties. As a coating method, an extrusion coating method and a curtain coating method are specifically useful which can coat two or more kind of layers concurrently.

In order to form a photographic image using the silver halide photographic light-sensitive material, an image recorded on the negative film may be optically image-formed on the silver halide photographic light-sensitive material to be printed. Aforesaid image may be temporarily converted to digital information and the resulting image may be image-formed on a CRT (cathode ray tube), and then, aforesaid image may be image-formed on the silver halide photographic light-sensitive material to be printed. Or, an image may be printed by scanning while the strength of the laser beam is changed based on digital information.

The light-sensitive material of the present invention does not preferably contain a developing agent in the light-sensitive material and is applied to a light-sensitive material forming an image for direct appreciation specifically. For example, it is applicable to color paper, color reversal paper, light-sensitive materials forming a positive image, light-sensitive materials for display use and light-sensitive materials for color proof use. Specifically, it is preferable to apply it to light-sensitive materials having a reflective support.

As an aromatic primary amine developing agent used for the color development of the silver halide light sensitive color photographic material, conventional compounds may be used. As examples of aforesaid compounds, the following compounds may be illustrated:

CD-1) N,N-diethyl-p-phenylenediamine

CD-2) 2-amino-5-diethylamino toluene

CD-3) 2-amino-5-(N-ethyl-N-laurylamino)toluene

CD-4) 4-(N-ethyl-N-β-hydroxyethylamino)aniline

CD-5) 2-methyl-4-(N-ethyl-N-β-hydroxyethylamino) aniline

CD-6) 4-amino-3-methyl-N-ethyl-N-(β-methansulfonamideethyl) aniline

CD-7) 4-amino-3-(β-methanesulfonamideethyl)-N,N-diethylaniline

CD-8) N, N-dimethyl-p-phenylenediamine

CD-9) 4-amino-3-methyl-N-ethyl-N-methoxyethylaniline

CD-10) 4-amino-3-methyl-(N-ethyl-N-β-ethoxyethyl) aniline

CD-11) 4-amino-3-methyl-(N-ethyl-N-γ-hydroxypropyl) aniline

The above-mentioned color developing composition may be used at an arbitrary pH region. However, from viewpoint of rapid processability, it is preferable that pH is 9.5 to 13.0, and it is more preferable that pH is 9.8 to 12.0.

The processing temperature of color developing of the present invention is 35° C. or more and 70° C. or less. The higher the temperature is, the shorter the processing time is. However, if the temperature is not too high, stability of the processing composition is acceptable. It is preferable to process at 37° C. or higher and 60° C. or lower.

Time for color developing is conventionally 3 minutes and 30 seconds. Less than 40 seconds is preferable in the present invention, and within 25 seconds is more preferable.

To a color developing solution, conventional developing composition components may be added in addition to the above-mentioned color developing agent. Ordinarily, an alkaline agent having pH buffer effect, development inhibitors such as chlorine ion and benzotriazole, preserver and a chelating agent are used.

The silver halide photographic light-sensitive material of the present invention may be subjected to bleaching process and fixing process after color developing. The bleaching process may be conducted concurrently with the fixing process. After fixing process, it is ordinary that washing process is applied. In place of the washing process, stabilizing process may be applied.

As a developing apparatus used for developing the silver halide photographic light-sensitive material of the present invention, a roller transportation type in which a lightsensitive material is sandwiched by rollers provided in the processing tank to be conveyed or an endless belt type in which the light-sensitive material is fixed on a belt. In addition, a system in which the processing tank is formed in a slit shaped form and the light-sensitive material is conveyed together with feeding the processing composition onto aforesaid processing tank, a spray type in which a processing composition is sprayed, a web type in which a carrier immersed in the processing composition is contacted and a type using a viscosity processing composition. When a light-sensitive material is processed in a large amount, it is ordinary to conduct running processing using an automatic developing machine. In this occasion, the replenishment amount of the replenisher composition is smaller, the preferable. The most preferable processing style from viewpoint of environment friendliness is to add a replenishing composition in a form of replenishing tablet. A method disclosed in Published Technical Report No. 16935/1994 is the most preferable.

The present invention is characterized in that the silver halide photographic light-sensitive material is processed with a color developing apparatus in which spacing thickness of a color developing tank is not more than one hundred times as thick as the thickness of said silver halide photographic light-sensitive material.

The present invention is further characterized in that said silver halide photographic light-sensitive material is processed by coating a processing solution.

EXAMPLES

The present invention is explained with reference to examples below. However, the present invention is not limited to these examples.

Example 1

A pulp paper having a weight of 170 g/m$^2$ was laminated on both sides by high density polyethylene to prepare a paper support. The surface on which the emulsion layer to be coated was laminated by a molten polyethylene in which 13% by weight of surface-treated anatase type titanium oxide was dispersed to prepare a reflective support. The reflective support was subjected to corona discharge treatment. Then the layers each having the following composition shown in Tables 1 and 2 were coated on the surface of the support to prepare a silver halide photographic light-sensitive material.

The coating solutions were prepared as follows.

First layer coating solution

To 60 ml of ethyl acetate, 23.4 g of yellow coupler (Y-1), 3.34 g of dye image stabilizing agent (ST-1), 3.34 g of dye image stabilizing agent (ST-2), 3.34 g of dye image stabilizing agent (ST-5), 0.34 g of stain preventing agent (HQ-1), 5.0 g of image stabilizing agent A, 5.0 g of high-boiling organic solvent (DBP) and 1.67 g of high-boiling organic solvent (DNP) were added and dissolved. The solution was dispersed in 220 m1 of a 10% aqueous solution of gelatin containing 7 m1 of a 20% solution of surfactant (SU-1) by using an ultrasonic homogenizer to prepare 500 ml of yellow coupler dispersion.

The dispersion was mixed with a blue-sensitive silver halide emulsion prepared under the following conditions to prepare a first layer coating solution.

Coating solutions for second through seventh layer were each prepared in the similar manner so that the coating amounts were as shown in Tables 1 and 2.

Compound (H-A) was added as a hardener. For adjusting the surface tension, surfactant (SU-2) was added.

TABLE 1

| Layer | Composition | Amount (g/m$^2$) |
|---|---|---|
| 7th layer (Protective layer) | Gelatin | 1.00 |
| | DBP | 0.002 |
| | DIDP | 0.002 |
| | Silicon dioxide | 0.003 |
| 6th layer (UV absorbing layer) | Gelatin | 0.40 |
| | Anti-irradiation dye (AI-1) | 0.01 |
| | UV (ultra violet rays) absorbent (UV-1) | 0.12 |
| | UV absorbent (UV-2) | 0.04 |
| | UV absorbent (UV-3) | 0.16 |
| | Stain preventing agent (HQ-5) | 0.04 |
| | PVP | 0.03 |
| 5th layer (Red-sensitive layer) | Gelatin | 1.30 |
| | Red-sensitive silver chlorobromide emulsion (Em-R) | 0.21 |
| | Cyan coupler (C-1) | 0.25 |
| | Cyan coupler (C-2) | 0.08 |
| | Image stabilizing agent (ST-1) | 0.10 |
| | Stain preventing agent (HQ-1) | 0.004 |
| | DBP | 0.10 |
| | DOP | 0.20 |
| 4th layer (UV absorbing layer) | Gelatin | 0.94 |
| | UV absorbing agent (UV-1) | 0.28 |
| | UV absorbing agent (UV-2) | 0.09 |
| | UV absorbing agent (UV-3) | 0.38 |
| | AI-1 | 0.02 |
| | Stain preventing agent (HQ-5) | 0.10 |

TABLE 2

| Layer | Composition | Amount (g/m$^2$) |
|---|---|---|
| 3rd layer (Green-sensitive layer) | Gelating | 1.30 |
| | AI-2 | 0.01 |
| | Green-sensitive silver chlorobromide emulsion (Em-G) | 0.14 |
| | Magenta coupler (M-1) | 0.20 |
| | Color image stabilizing agent (ST-3) | 0.20 |
| | Color image stabilizing agent (ST-4) | 0.17 |
| | DIDP | 0.13 |
| | DBP | 0.13 |
| 2nd layer (Interlayer) | Gelatin | 1.20 |
| | AI-3 | 0.01 |
| | Stain preventing agent (HQ-2) | 0.03 |
| | Stain preventing agent (HQ-3) | 0.03 |
| | Stain preventing agent (HQ-4) | 0.05 |
| | Stain preventing agent (HQ-5) | 0.23 |
| | DIDP | 0.04 |
| | DBP | 0.02 |
| | Flourescent whitening agent (W-1) | 0.10 |
| 1st layer (Blue-sensitive layer) | Gelatin | 1.20 |
| | Blue-sensitive silver chlorobromide emulsion (Em-B) | 0.26 |
| | Yellow coupler (Y-1) | 0.70 |
| | Image stabilizing agent (ST-1) | 0.10 |
| | Image stabilizing agent (ST-2) | 0.10 |
| | Stain preventing agent (HQ-1) | 0.01 |
| | Image stabilizing agent (ST-5) | 0.10 |
| | Image stabilizing agent A | 0.15 |
| | DNP | 0.05 |
| | DBP | 0.15 |
| Support | Polyethylene laminated paper (containing a slight amount of a tinting agent). | |

In the above, the amounts of silver halide emulsions are each described in terms of silver amount.

SU-1: Sodium tri-i-propylnaphthalenesulfonate

SU-2: Sodium salt of di-(2-ethylhexyl) sulfosuccinate

DBP: Dibutyl phthalate

DNP: Dinonyl phthalate

DOP: Dioctyl phthalate

DIDP: Di-i-decyl phthalate
PVP: Polyvinylpyrrolidone
H-A: Sodium salt of 2,4-dichloro-6-hydroxy-s-triazine
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl) butylhydroquinone
Image stabilizing agent A: p-t-octylphenol
Y-1
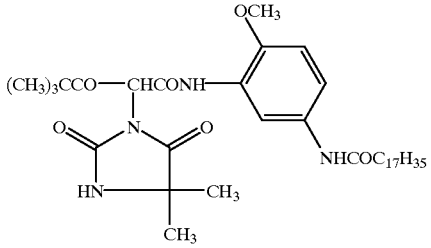
M-1
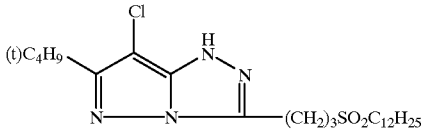
C-1
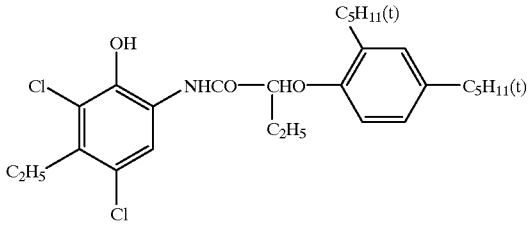
C-2
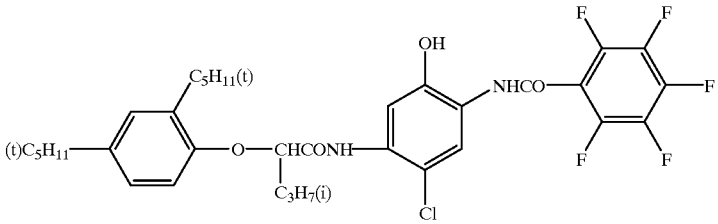
ST-1
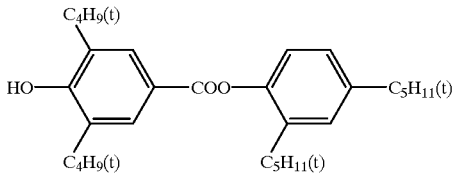
ST-2
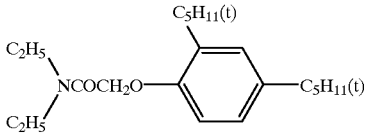
ST-3
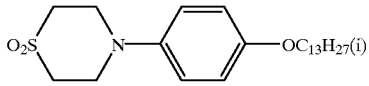

-continued
ST-4
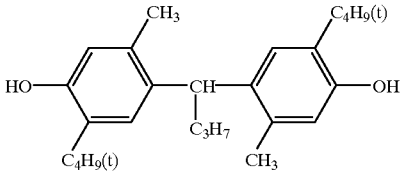
ST-5
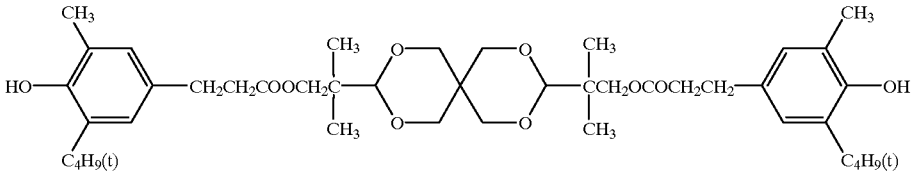
UV-1
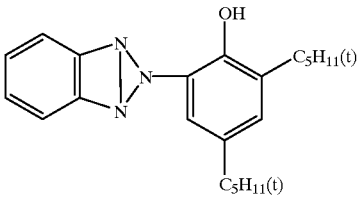
UV-2
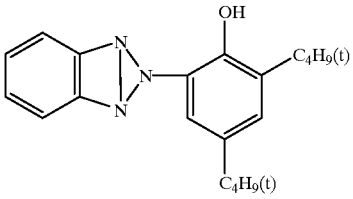
UV-3
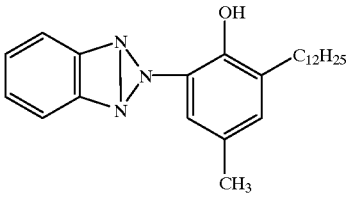
Al-1
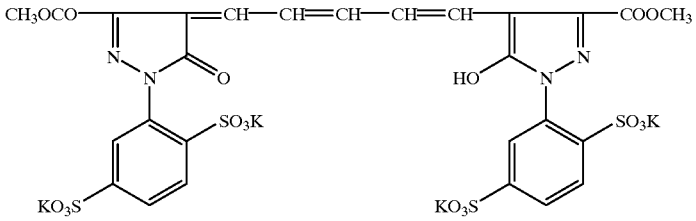
Al-2
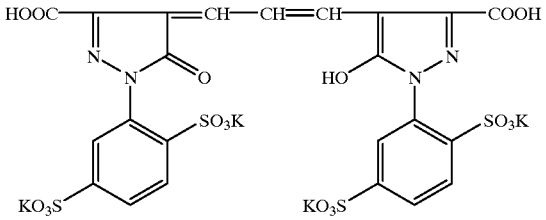

-continued

Al-3

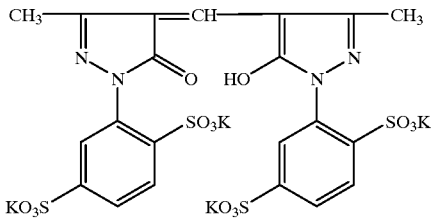

W-1

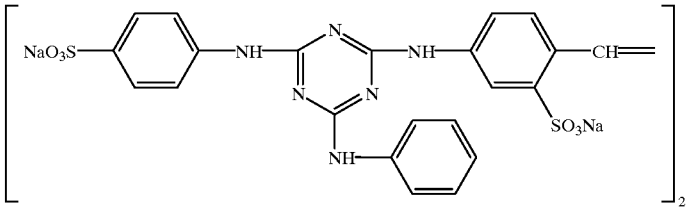

(Preparation of blue-sensitive silver halide emulsion)

The following (Solution A) and (Solution B) were added by a double-jet method taking 30 minutes to 1 liter of a 2% aqueous gelatin solution maintaining at 40 C while the pAg and pH were kept at 7.3 and 3.0, respectively. Then (Solution C and (Solution D) were concurrently added taking 180 minutes by a double-jet method while the pH and pAg were kept at 8.0 and 5.5, respectively. The control of the pAg was carried out by the method described in JP-A No. 59-45437, and the control of the pH was carried out by the use of sulfuric acid or sodium hydroxide.

Solution A

| | |
|---|---|
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |
| Water to make | 600 ml |
| Solution D | |
| Silver nitrate | 300 g |
| Water to make | 600 ml |

After completion of the addition, the emulsion was desalted using a 5% aqueous solution of Demol N, manufactured by Kao-Atlas Co. Ltd., and a 20% aqueous solution of magnesium sulfate. Then the emulsion was mixed with an aqueous gelatin solution. Thus, a monodisperse cubic emulsion EMP-1 was prepared, which had an average grain diameter of 0.71 $\mu$m, a variation coefficient of grain distribution of 0.07 and a silver chloride content of 99.5 mole-%.

A monodisperse cubic emulsion EMP-LB was prepared in the same manner as employed in preparing EMP-1 except that the time for addition of (Solution A) and (Solution B), and that of (Solution C) and (Solution D) were changed. EMP-1B had an average grain diameter of 0.64 $\mu$m, a variation coefficient of grain distribution of 0.07 and a silver chloride content of 99.5 mole-%.

EMP-1 was subjected to optimal chemical sensitization at 60° C. using the following compounds. In addition, EMP-1B was subjected to optimal chemical sensitization in a similar manner to the above. Then, the sensitized EMP-1 and EMP-1B were mixed together in a ratio of 1:1 in terms of silver amount. Thus, blue-sensitive silver halide emulsion Em-B was obtained.

| | |
|---|---|
| Sodium thiosulfate | 0.8 mg/mol of AgX |
| Chloroauric acid | 0.5 mg/mol of AgX |
| Stabilizing agent STAB-1 | $3 \times 10^{-4}$ mol/mol of AgX |
| Stabilizing agent STAB-2 | $3 \times 10^{-4}$ mol/mol of AgX |
| Stabilizing agent STAB-3 | $3 \times 10^{-4}$ mol/mol of AgX |
| Sensitizing dye BS-1 | $4 \times 10^{-4}$ mol/mol of AgX |
| Sensitizing dye BS-2 | $1 \times 10^{-4}$ mol/mol of AgX |

(Preparation of green-sensitive silver halide emulsion)

A monodisperse cubic emulsion EMP-2 was prepared in the same manner as employed in preparing EMP-1 except that the time for addition of (Solution A) and (Solution B), and that of (Solution C) and (Solution D) were changed. EMP-2 had an average grain diameter of 0.40 $\mu$m, a variation coefficient of grain distribution of 0.08 and a silver chloride content of 99.5 mole-%.

Subsequently, a monodisperse cubic emulsion EMP-2B having an average grain diameter of 0.50 $\mu$m, a variation coefficient of grain distribution of 0.08 and a silver chloride content of 99.5 mole-% was prepared.

EMP-2 was subjected to optimal chemical sensitization at 55° C. using the following compounds. In addition, EMP-2B was subjected to optimal chemical sensitization in a similar manner to the above. Then, the sensitized EMP-2 and EMP-2B were mixed together in a ratio of 1 : 1 in terms of silver amount. Thus, green-sensitive silver halide emulsion Em-G was obtained.

| | |
|---|---|
| Sodium thiosulfate | 1.5 mg/mol of AgX |
| Chloroauric acid | 1.0 mg/mol of AgX |
| Stabilizing agent STAB-1 | $3 \times 10^{-4}$ mol/mol of AgX |
| Stabilizing agent STAB-2 | $3 \times 10^{-4}$ mol/mol of AgX |
| Stabilizing agent STAB-3 | $3 \times 10^{-4}$ mol/mol of AgX |
| Sensitizing dye GS-1 | $4 \times 10^{-4}$ mol/mol of AgX |

(Preparation of red-sensitive silver halide emulsion)

A monodisperse cubic emulsion EMP-3 was prepared in the same manner as employed in preparing EMP-1 except that the time for addition of (Solution A) and (Solution B), and that of (Solution C) and (Solution D) were changed. EMP-3 had an average grain diameter of 0.40 μm, a variation coefficient of grain distribution of 0.08 and a silver chloride content of 99.5 mole-%. In addition, a monodisperse cubic emulsion EMP-3B having an average grain diameter of 0.38 μm, a variation coefficient of grain distribution of 0.08 and a silver chloride content of 99.5 mole-% was prepared.

The above-mentioned EMP-3 was subjected to optimal chemical sensitization at 60° C. using the following compounds. In addition, EMP-3B was subjected to optimal chemical sensitization in a similar manner to the above. Then, the sensitized EMP-3 and EMP-3B were mixed together in a ratio of 1:1 in terms of silver amount. Thus, red-sensitive silver halide emulsion Em-R was obtained.

| | |
|---|---|
| Sodium thiosulfate | 1.8 mg/mol of AgX |
| Chloroauric acid | 2.0 mg/mol of AgX |
| Stabilizing agent STAB-1 | $3 \times 10^{-4}$ mol/mol of AgX |
| Stabilizing agent STAB-2 | $3 \times 10^{-4}$ mol/mol of AgX |
| Stabilizing agent STAB-3 | $3 \times 10^{-4}$ mol/mol of AgX |
| Sensitizing dye RS-1 | $1 \times 10^{-4}$ mol/mol of AgX |
| Sensitizing dye RS-2 | $1 \times 10^{-4}$ mol/mol of AgX |

Further, to the red-sensitive silver halide emulsion Em-R was added a supersensitizer (SS-1) in an amount of $2.0 \times 10^{-3}$ mol/mol of AgX.

STAB-1: 1-(3-acetoamidophenyl)-5-mercaptotetrazole

STAB-2: 1-phenyl-5-mercaptotetrazole

STAB-3: 1-(4-ethoxyphenyl)-5-mercaptotetrazole

BS-1

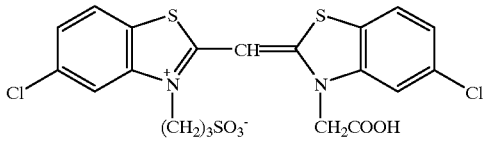

BS-2

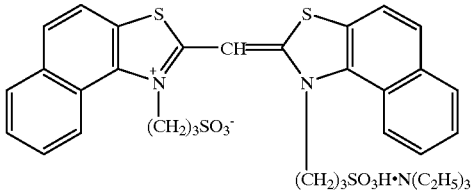

GS-1

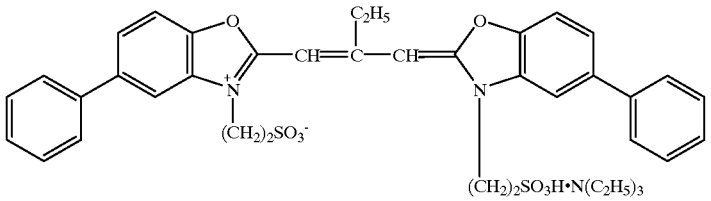

RS-1

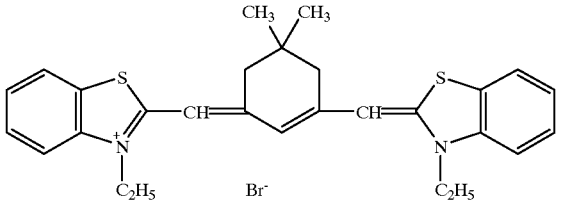

RS-2

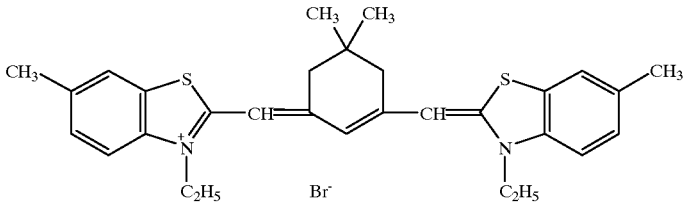

-continued

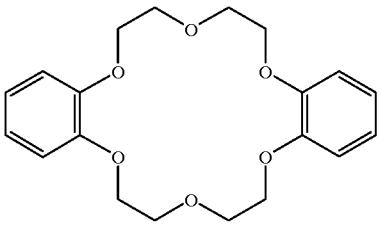

SS-1

Thus, a multilayer light-sensitive material, Sample 101 was obtained. The hardener, H-A was added to the 7th layer of Sample 101 in an amount of 83 mg/m$^2$ of the light-sensitive material. Sample 102 was obtained in a similar manner to the above in which Sample 101 was obtained except replacing the hardener by a hardener as shown in Table 3. Further, Samples 103 to 117 were obtained in a similar manner to the above in which Sample 102 was obtained, except replacing the hardener by hardeners and compounds represented by Formula (1), added to layers as shown in Table 3, and in amounts as shown in Table 3, respectively.

The total gelatin amount and total amount of silver halide contained in silver halide emulsion layers are shown in Table 3. In this case, the total amount of silver halide is converted into a total silver amount. When the total amount of coated gelatin and the total amount of coated silver are decreased or increased, the ratio of the coated gelatin amount to the coated silver amount contained in each layer of each sample is maintained as a constant as that of the coated gelatin amount to the coated silver amount contained in each layer of Sample 102. The additional mol of each hardener is the same as that of the hardener used in preparing Sample 101. A layer to which the hardener is added is shown in Table 3. When the hardener is added to plural layers, total additional mol of the hardener is the same as that of the hardener used in preparing Sample 101.

Employing these Samples, photographic characteristics were evaluated in the following manner.

<Fog resistance of unexposed Samples>

5 sheets with wedge size were placed by superposing the emulsion side upward, and the thus obtained 5 superposed sheets were enclosed in a black polyethylene double bag and the above obtained bag was stored under conditions of 65° C. and 40% RH (relative humidity) for 10 days, after that the bag was allowed to stand under conditions of 25° C. and 50% RH for one day. The thus treated unexposed sheets were processed with the following color developing process A. Reflection density of the center area of the undermost sheet of 5 superposed sheets was measured by the use of 310 RT densitometer produced by X-Rite Co.

As the reflection density to a blue light is low, yellow fogging is less and the fog resistance of the unexposed sample is considered more excellent.

<Scratch resistance of unexposed Samples>

An unexposed sample was cut into wedge size sheets and the thus obtained sheets were set according to a method regulated for use of a scratch resistance tester using continuously increasing weight (Heidon) 18 type (produced by Shinto Kagaku Co.). When a load of 0 to 100 g is continuously placed on the surface of the unexposed sheet, the weight (g) of the load with which scratch on the surface of the unexposed sheets began to occur was noted. With said noted values, the scratch resistance was evaluated. As the value increases, the scratch resistance is considered more excellent. In conducting the scratch resistance test, a 0.1 mmϕ diamond needle was employed.

<Rapid hardening ability>

An unexposed sample was allowed to stand under conditions of 23° C. and 55% RH for one day and then immersed for 45 seconds in a color developing solution regulated at 35° C. The swelling ratio was obtained by a weight ratio of the weight of the unexposed sample before being immersed, to the weight of the unexposed sample after being immersed.

Swelling ratio (%)=[(weight of unexposed sample after being immersed)−(weight of unexposed sample before being immersed)]/[(weight of unexposed sample before being immersed)−(weight of support)]×100.

When the swelling ratio of the unexposed sample is between 120 and 140%, the unexposed sample exhibits rapid hardening ability.

(Color developing process A)

| Processing Steps | Processing Temperature | Processing Time | Replenishing Amount |
|---|---|---|---|
| Color Developing | 38.0 ± 0.3° C. | 45 sec. | 80 ml |
| Bleach Fixing | 35.0 ± 0.5° C. | 45 sec. | 120 ml |
| Stabilizing | 30.0 − 34.0° C. | 60 sec. | 150 ml |
| Drying | 60 − 80° C. | 30 sec. | |

Composition of the developing solution will be illustrated as below:

Color developing tank solution and replenishing solution

| | Tank solution | Replenishing solution |
|---|---|---|
| Deionized water | 800 ml | 800 ml |
| Triethylene diamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamide ethyl)-3-methyl-4-aminoaniline sulfate | 6.0 g | 10.0 g |
| N, N-diethythydroxylamine | 6.8 g | 6.0 g |
| Triethanolamine | 10.0 g | 10.0 g |
| Sodium salt of diethylenetriamine pentaacetic acid | 2.0 g | 2.0 g |
| Fluorescent brightening agent (4,4'-diaminostylbene disulfonic acid derivative) | 2.0 g | 2.5 g |
| Potassium carbonate | 30 g | 30 g |

Water was added to make 1 liter in total. Tank solution was adjusted to pH=10.10, and the replenishing solution was adjusted to pH=10.60.

Bleach fixing tank solution and its replenishing solution

Ferric ammonium dihydride of diethylenetriamine

| | |
|---|---|
| pentaacetic acid | 65 g |
| Diethylenetriamine pentaacetic acid | 3 g |
| Ammonium thiosulfate (an aqueous 70% solution) | 100 ml |
| 2-amino-5-mercapto-1,3,4-thiadiazole | 2.0 g |
| Ammonium sulfite (an aqueous 40% solution) | 27.5 ml |

Water was added to make 1 liter in total, and pH was adjusted to 5.0 using potassium carbonate or glacial acetic acid.

Stabilizing tank solution and its replenishing solution

| | |
|---|---|
| o-phenylphenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent brightening agent (Chinopal SFP) | 2.0 g |
| 1-hydroxyethylidene-1,1-diphosphonic acid | 1.8 g |
| Bismuth chloride (an aqueous 45% solution) | 0.65 g |
| Magnesium sulfate heptahydride | 0.2 g |
| PVP | 1.0 g |
| Aqueous ammonia (an aqueous 25% ammonium hydroxide solution) | 2.5 g |
| Trisodium salt of nitrilo triacetic acid | 1.5 g |

Water was added to make 1 liter in total, and pH was adjusted to 7.5 using sulfuric acid or aqueous ammonia.

Obtained results are shown in Table 3.

TABLE 3

| | Hardener | | Compound represented by Formula (1) | | |
|---|---|---|---|---|---|
| Sample No. | Kind | Addition layer | Kind | Addition layer | Additional amount (mg/m$^2$) |
| 101 (Comp.) | H-A | 7th layer | — | — | — |
| 102 (Comp.) | H-21 | 7th layer | — | — | — |
| 103 (Inv.) | H-4 | 7th layer | HC-1 | 7th layer | 300 |
| 104 (Inv.) | H-3 | 5th/7th layer | HC-4 | 5th layer | 800 |
| 105 (Inv.) | H-26 | 2nd layer | HC-3 | 2nd layer | 600 |
| 106 (Inv.) | H-27 | 2nd/4th/7th layer | HC-5 | 2nd/4th layer | 300/300 |
| 107 (Inv.) | H-31 | 7th layer | HC-6 | 2nd/4th/7th layer | 200/200/100 |
| 108 (Inv.) | H-32 | 3rd/7th layer | HC-2 | 3rd layer | 200 |
| 109 (Inv.) | H-33 | 2nd/4th/7th layer | HC-7 | 2nd/6th layer | 200/200 |
| 110 (Comp.) | H-A | 2nd/4th/7th layer | HC-3 | 2nd/4th layer | 400/200 |
| 111 (Inv.) | H-27 | 2nd/4th/7th layer | HC-5 | 2nd/4th layer | 400/200 |
| 112 (Inv.) | H-26 | 7th layer | HC-3 | 2nd layer | 600 |
| 113 (Inv.) | H-32 | 2nd/6th/layer | HC-2 | 3rd layer | 200 |
| 114 (Inv.) | H-30 | 1st/3rd/7th layer | HC-2 | 2nd/4th/7th layer | 100/200/200 |
| 115 (Inv.) | H-30 | 1st/3rd/5th layer | HC-2 | 4th layer | 500 |
| 116 (Inv.) | H-29 | 3rd layer | HC-6 | 3rd layer | 400 |
| 117 (Inv.) | H-29 | 3rd layer | HC-6 | 2nd layer | 400 |

TABLE 3-continued

| Sample No. | Total gelatin amount (g/m$^2$) | Total silver amount (g/m$^2$) | Fog resistance | Scratch resistance (g) | Swelling ratio (%) |
|---|---|---|---|---|---|
| 101 (Comp.) | 7.34 | 0.61 | 0.65 | 54 | 322 |
| 102 (Comp.) | 7.34 | 0.61 | 0.42 | 58 | 200 |
| 103 (Inv.) | 7.34 | 0.61 | 0.30 | 63 | 140 |
| 104 (Inv.) | 7.34 | 0.61 | 0.30 | 63 | 135 |
| 105 (Inv.) | 7.34 | 0.61 | 0.24 | 64 | 130 |
| 106 (Inv.) | 6.50 | 0.61 | 0.22 | 66 | 125 |
| 107 (Inv.) | 7.34 | 0.58 | 0.23 | 65 | 130 |
| 108 (Inv.) | 6.50 | 0.57 | 0.20 | 67 | 122 |
| 109 (Inv.) | 6.50 | 0.56 | 0.19 | 67 | 122 |
| 110 (Comp.) | 6.40 | 0.55 | 0.65 | 55 | 177 |
| 111 (Inv.) | 6.40 | 0.55 | 0.30 | 64 | 138 |
| 112 (Inv.) | 7.34 | 0.61 | 0.25 | 63 | 131 |
| 113 (Inv.) | 6.30 | 0.57 | 0.21 | 66 | 121 |
| 114 (Inv.) | 6.40 | 0.55 | 0.22 | 65 | 130 |
| 115 (Inv.) | 6.40 | 0.55 | 0.23 | 66 | 129 |
| 116 (Inv.) | 6.40 | 0.55 | 0.24 | 66 | 135 |
| 117 (Inv.) | 6.40 | 0.55 | 0.25 | 67 | 133 |

Comp.; Comparison, Inv.; Invention

As can be seen from Table 3, the samples of the present invention are proved to be more excellent than the comparative ones.

Example 2

Effect of the present invention was confirmed for Samples 101–110 used in Example 1 in the same way as employed in Example 1 except for replacing color developing process A with the following color developing process B.

Color developing process B

| Processing Steps | Processing Temperature | Processing Time | Replenishing Amount |
|---|---|---|---|
| Color Developing | 38.0 ± 0.3° C. | 22 sec. | 81 ml |
| Bleach Fixing | 35.0 ± 0.5° C. | 22 sec. | 54 ml |
| Stabilizing | 30.0 – 34.0° C. | 25 sec. | 150 ml |
| Drying | 60 – 80° C. | 30 sec. | |

The developing solution composition will be illustrated as below:

Color developing tank solution and replenishing solution

| | Tank solution | Replenishing solution |
|---|---|---|
| Deionized water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamide ethyl)-3-methyl-4-aminoaniline sulfate | 6.0 g | 10.5 g |
| N, N-diethythydroxylamine | 3.5 g | 6.0 g |
| N, N-bis(2-sulfoethyl)hydroxylamine | 3.5 g | 6.0 g |
| Triethanolamine | 10.0 g | 10.0 g |
| Sodium salt of diethylenetriamine pentaacetic acid | 2.0 g | 2.0 g |
| Fluorescent brightening agent (4,4'-diaminostylbene disulfonic acid derivative) | 2.0 g | 2.5 g |
| Potassium carbonate | 30.0 g | 30.0 g |

Water was added to make 1 liter in total. Tank solution was adjusted to pH=10.10, and the replenishing solution was adjusted to pH=10.60.

Bleach fixing tank solution and its replenishing solution

| | Tank solution | Replenishing solution |
|---|---|---|
| Ferric ammonium dihydride of diethylenetriamine pentaacetic acid | 100 g | 50 g |
| Diethylenetriamine pentaacetic acid | 3 g | 3 g |
| Ammonium thiosulfate (an aqueous 70% solution) | 200 ml | 100 ml |
| 2-amino-5-mercapto-1,3,4-thiadiazole | 2 g | 1 g |
| Ammonium sulfite (an aqueous 40% solution) | 50 ml | 25 ml |

Water was added to make 1 liter in total, and pH of the tank solution was adjusted to 7.0 and that of replenishing solution was adjusted to 6.5 using potassium carbonate or glacial acetic acid.

Stabilizing tank solution and its replenishing solution

| | |
|---|---|
| o-phenylphenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent brightening agent (Chinopal SFP) | 2.0 g |
| 1-hydroxyethylidene-1,1-diphosphonic acid | 1.8 g |
| PVP | 1.0 g |
| Aqueous ammonia (an aqueous 25% ammonium hydroxide solution) | 2.5 g |
| Ethylenediamine tetraacetic acid | 1.0 g |
| Ammonium sulfite (an aqueous 40% solution) | 10 ml |

Water was added to make 1 liter in total, and pH was adjusted to 7.5 using sulfuric acid or aqueous ammonia.

Example 3

In Example 1, running process was conducted according to Process CPK-2-Jl employing NPS-868J (produced by Konica Co.) as an automatic processor and ECOJET-P (produced by Konica Co.) as a processing chemical. The effect of the present invention was confirmed by evaluating in the same manner as employed in Example 1.

Example 4

Samples 201 to 210 were produced in the same manner as employed in producing Samples 101 to 110 used in Example 1 except that surfactants of the present invention were added to the 7th layer. The kind and additional amount of said surfactants are shown in Table 4.

These samples were processed in the same manner as employed in Example 1 and evaluation of the fog resistance, scratch resistance and rapid hardening ability of the unexposed samples was conducted. As a result of said evaluation, the unexposed samples of the present invention were proved to be more excellent than the comparative ones. Further, sharpness degradation was evaluated according to the following method.

<Sharpness over passage of time>

Each sample was printed through a resolution test chart by exposing it to a red light after which it was processed with the above-mentioned color developing process, and following that a density of the thus obtained cyan image was measured by the use of a microdensitometer PDM-5D (produced by Konica Co.). Sharpness of a fresh sample is defined as follows.

Sharpness of fresh sample (%)=(Dmax−Dmin of densely printed image of 3 lines/mm)/(Dmax−Dmin of large area), wherein Dmax is the maximum density and Dmin is the minimum density.

In addition, the above-mentioned fresh sample was stored under conditions of a relatively high temperature of 75° C. and high humidity of 60% RH for 14 days, after which sharpness evaluation was conducted in the same manner as mentioned above.

Sharpness degradation over passage of time was obtained according to the following Formula.

Sharpness degradation=sharpness (%) of sample stored under high temperature and high humidity/sharpness (%) of a fresh sample.

As this value approaches 1, the sharpness degradation is considered to be less.

Obtained results are collectively shown in Table 4.

TABLE 4

| | Surfactant | | |
|---|---|---|---|
| Sample No. | Kind | Additional amount ($mg/m^2$) | Sharpness degradation over passage of time |
| 101 (Comp.) | — | — | 0.70 |
| 102 (Comp.) | — | — | 0.72 |
| 201 (Comp.) | B-4 | 20 | 0.71 |
| | FA-22 | 5 | |
| 202 (Comp.) | B-10 | 10 | 0.73 |
| | FA-33 | 5 | |
| 203 (Inv.) | B-1 | 15 | 0.76 |
| 204 (Inv.) | B-20 | 10 | 0.78 |
| | FK-3 | 10 | |
| 205 (Inv.) | B-2 | 20 | 0.76 |
| 206 (Inv.) | B-6 | 15 | 0.79 |
| | FA-14 | 5 | |
| 207 (Inv.) | B-3 | 10 | 0.79 |
| | FA-25 | 5 | |
| 208 (Inv.) | B-18 | 10 | 0.78 |
| | FA-16 | 5 | |
| 209 (Inv.) | B-11 | 15 | 0.79 |
| | FK-1 | 5 | |
| 210 (Inv.) | B-7 | 15 | 0.73 |

Comp.; Comparision, Inv.; Invention

As can be seen from Table 4, the inventive samples were proved to be more excellent than the comparative ones.

Example 5

In Example 4, samples were processed in the same manner as employed in Example 2, and the same evaluation as employed in Example 4 was conducted, consequently the effect of the present invention was confirmed.

Example 6

In Example 4, samples were processed in the same manner as employed in Example 3, and the same evaluation as employed in Example 4 was conducted, consequently the effect of the present invention was confirmed.

Example 7

An additional layer (the undermost layer) was coated under the 1st layer of Samples 101 to 110 used in Example 1 so as to obtain Samples 301 to 310. The coated gelatin amount of said layer and total coated gelatin amount are as shown in Table 5 by uniformly decreasing the coated gelatin amount of each layer.

These samples were processed in the same manner as employed in Example 1 and evaluation of the fog resistance, scratch resistance and rapid hardening ability of the unexposed samples was conducted. As a result of said evaluation, the unexposed samples of the present invention were proved to be more excellent than the comparative ones. Further, sharpness degradation was evaluated in the same manner as described in Example 4.

Obtained results are shown in Table 5.

TABLE 5

| Sample No. | Total gelatin amount ($g/m^2$) | Gelatin amount of the undermost layer ($g/m^2$) | Sharpness degradation over passage of time |
|---|---|---|---|
| 101 (Comp.) | 7.34 | — | 0.70 |
| 102 (Comp.) | 7.34 | — | 0.72 |
| 301 (Comp.) | 7.34 | 0.01 | 0.72 |
| 302 (Comp.) | 7.34 | 0.01 | 0.73 |
| 303 (Inv.) | 7.30 | 0.90 | 0.77 |
| 304 (Inv.) | 7.20 | 0.50 | 0.77 |
| 305 (Inv.) | 7.30 | 0.04 | 0.77 |
| 306 (Inv.) | 6.40 | 0.30 | 0.80 |
| 307 (Inv.) | 7.34 | 0.10 | 0.79 |
| 308 (Inv.) | 6.50 | 0.30 | 0.79 |
| 309 (Inv.) | 6.30 | 0.60 | 0.80 |
| 310 (Inv.) | 6.40 | 0.50 | 0.73 |

Comp.; Comparision, Inv.; Invention

As can be seen from Table 5, the inventive samples were proved to be more excellent than the comparative ones.

Example 8

In Example 7, samples were processed in the same manner as employed in Example 2, and the same evaluation as employed in Example 7 was conducted, consequently the effect of the present invention was confirmed.

Example 9

In Example 7, samples were processed in the same manner as employed in Example 3, and the same evaluation as employed in Example 7 was conducted, consequently the effect of the present invention was confirmed.

Example 10

Samples 401 to 404 were obtained in the same manner as employed in obtaining Samples 101, 102, 106 and 110 except that surface of the white polyester support used for obtaining Samples 101, 102, 106 and 110 was subjected to an energy treatment described in JP-A No. 10-20443 so that said support produced an amino group on its surface.

These samples were processed in the same manner as employed in Example 1 and evaluation of the fog resistance, scratch resistance and rapid hardening ability of the unexposed samples was conducted. As a result of said evaluation, the unexposed samples of the present invention were proved to be more excellent than comparative ones. Further, scratch resistance of these samples, when being wet, was evaluated according to the following method.

<Scratch resistance when being wet>

Black samples obtained by exposing the above-mentioned samples to a white light and processing them in a processing solution were cut into wedge size and then the thus obtained black samples with the wedge size were immersed for 3 minutes in water regulated at 35° C. After that, scratch resistance of the thus treated samples was measured according to the following method. The black samples were set according to a method regulated for the use of an scratch resistance tester using continuously increasing weight (Heidon, previously mentioned) 18 type. When a load of 0 to 50 g is continuously placed on the surface of the black samples, the weight (g) of the load with which scratch on the surface of the black samples began to occur was noted. With said noted values, the scratch resistance was evaluated. As the value increases, the scratch resistance is considered more excellent. In conducting the scratch resistance test, a 0.2 mmϕ sapphire needle was employed.

As can be seen from the obtained results as shown below, the inventive samples are proved to be more excellent in the scratch resistance, when being wet, than the comparative ones.

| Sample No. | Scratch resistance when being wet (g) |
|---|---|
| 101 (Comparison) | 20 |
| 102 (Comparison) | 21 |
| 106 (Comparison) | 23 |
| 110 (Comparison) | 21 |
| 401 (Comparison) | 25 |
| 402 (Comparison) | 27 |
| 403 (Invention) | 38 |
| 404 (Comparison) | 25 |

Example 11

In Example 10, samples were processed in the same manner as employed in Example 2, and the same evaluation as employed in Example 10 was conducted, consequently the effect of the present invention was confirmed.

Example 12

In Example 10, samples were processed in the same manner as employed in Example 3, and the same evaluation as employed in Example 10 was conducted, consequently the effect of the present invention was confirmed.

Example 13

Samples 501 to 510 were produced in the same manner as employed in producing Samples 101 to 110, except for replacing the yellow coupler used in producing Samples 101 to 110, by couplers as shown in Table 6.

These samples were processed in the same manner as employed in Example 1 and evaluation of the fog resistance, scratch resistance and rapid hardening ability of the unexposed samples was conducted. As a result of said evaluation, the unexposed samples of the present invention were proved to be more excellent than comparative ones. Further, yellow dye forming efficiency of said yellow couplers was evaluated according to the following method.

<Yellow dye forming efficiency>

Each sample was exposed to light in a conventional way and processed with color developing process. The maximum yellow density (Dmax) of a blue light-sensitive emulsion layer of the thus obtained sample was measured. As this Dmax increases, the yellow dye forming efficiency is considered more excellent.

Obtained results are shown in Table 6.

TABLE 6

| Sample No. | Yellow coupler | Dmax |
|---|---|---|
| 101 (Comp.) | Y-1 | 2.10 |
| 102 (Comp.) | Y-1 | 2.11 |

TABLE 6-continued

| Sample No. | Yellow coupler | Dmax |
|---|---|---|
| 501 (Comp.) | (2) | 2.12 |
| 502 (Comp.) | (2) | 2.12 |
| 503 (Inv.) | (2) | 2.14 |
| 504 (Inv.) | (19) | 2.14 |
| 505 (Inv.) | (26) | 2.16 |
| 506 (Inv.) | (4) | 2.16 |
| 507 (Inv.) | (15) | 2.15 |
| 508 (Inv.) | (11) | 2.14 |
| 509 (Inv.) | (3) | 2.15 |
| 510 (Comp.) | (21) | 2.12 |

Comp.; Comparison, Inv.; Invention

As can be seen from Table 6, the inventive samples are proved to be more excellent than the comparative ones.

Example 14

In Example 13, samples were processed in the same manner as employed in Example 2, and the same evaluation as employed in example 13 was conducted, consequently the effect of the present invention was confirmed.

Example 15

In Example 13, samples were processed in the same manner as employed in Example 3, and the same evaluation as employed in Example 13 was conducted, consequently the effect of the present invention was confirmed.

Example 16

Samples as shown in Table 7 were processed under the following processing condition so as to evaluate the fog resistance of the unexposed samples. As a result of said evaluation, the samples of the present invention were proved to be more excellent than the comparative ones. In addition, the yellow dye forming efficiency was evaluated in the same manner as employed in Example 13.

The inventive samples and comparative samples were processed by employing a processing system in which spacing thickness of a developing tank was 2.5 mm and an amount of color developing solution contained in said developing tank occupied about 60% of the total amount of all processing solutions. The following Color developing process C was employed.

(Color developing process C)

| Processing Steps | Processing Temperature | Processing Time | Replenishing Amount |
|---|---|---|---|
| Color Developing | 42.0 ± 0.3° C. | 18 sec. | 65 ml |
| Bleach Fixing | 38.0 ± 0.5° C. | 19 sec. | 60 ml |
| Stabilizing | 30.0 – 34.0° C. | 16 sec. | 120 ml |
| Drying | 60 – 80° C. | 27 sec. | |

The developing solution composition will be illustrated as below:

Color developing tank solution and replenishing solution

| | Tank solution | Replenishing solution |
|---|---|---|
| Deionized water | 800 ml | 800 ml |
| Diethylene glycol | 15 g | 15 g |
| Potassium bromide | 0.02 g | 0.008 g |
| Potassium chloride | 3.0 g | 0.3 g |
| Potassium sulfite | 0.25 g | 0.5 g |
| N-ethyl-N-(β-methanesulfonamide ethyl)-3-methyl-4-aminoaniline sulfate | 8.0 g | 15.0 g |
| N, N-bis(2-sulfoethyl)hydroxylamine | 6.0 g | 6.0 g |
| Sodium salt of diethylenetriamine pentaacetic acid | 5.0 g | 7.5 g |
| Sodium p-toluenesulfonate | 15.0 g | 15.0 g |
| Potassium carbonate | 33.0 g | 30.0 g |

Water was added to make 1 liter in total. Tank solution was adjusted to pH=10.10, and the replenishing solution was adjusted to pH=10.40.

Bleach fixing tank solution and its replenishing solution

| | Tank solution | Replenishing solution |
|---|---|---|
| Ferric ammonium salt of ethylenediamine succinic acid | 0.20 mol | 0.32 mol |
| Ethylenediamine succinic acid | 0.02 mol | 0.032 mol |
| Ammonium thiosulfate | 0.65 mol | 1.04 mol |
| Ammonium sulfite | 0.12 mol | 0.192 mol |

Water was added to make 1 liter in total, and pH of the tank solution was adjusted to 6.0 and that of replenishing solution was adjusted to 5.0 using potassium carbonate or glacial acetic acid.

| Stabilizing tank solution and its replenishing solution | |
|---|---|
| o-phenylphenol | 0.1 g |
| Fluorescent brightening agent (Chinopal SFP) | 1.0 g |
| Zinc sulfate $7H_2O$ | 0.1 g |
| 1-hydroxyethylidene-1,1-diphosphonic acid (an aqueous 60% solution) | 3.0 g |
| Ethylenediamine tetraacetic acid | 1.5 g |
| Ammonium sulfite (an aqueous 40% solution) | 5.0 ml |

Water was added to make 1 liter in total, and pH was adjusted to 7.8 using sulfuric acid or aqueous ammonia.

Results are shown in Table 7.

TABLE 7

| Sample No. | Dmax |
|---|---|
| 101 (Comparison) | 2.11 |
| 102 (Comparison) | 2.12 |
| 202 (Comparison) | 2.12 |
| 302 (Comparison) | 2.11 |
| 502 (Comparison) | 2.13 |
| 204 (Invention) | 2.16 |
| 308 (Invention) | 2.16 |
| 403 (Invention) | 2.17 |
| 509 (Invention) | 2.16 |
| 406 (Invention) | 2.17 |
| 106 (Invention) | 2.17 |
| 306 (Invention) | 2.16 |

As can be seen from Table 7, the inventive samples are proved to be excellent than the comparative ones.

Example 17

The sample used in Example 16 were processed under the following developing condition and the same evaluation as employed in Example 16 was conducted, consequently the effect of the present invention was confirmed.

As a processing apparatus, a coating processing solution method was employed. The first color developing solution consisting of the following components (a) was coated on the surface of the emulsion layer of the light-sensitive material which was heated by means of heating medium of said processing apparatus, continuously the second color developing solution consisting of the following components (b) was coated on said surface so that color development was accomplished. The second color developing solution (b) was coated 0.5 sec. later after the first color developing solution (a) was coated.

Processing process including the above-mentioned color development process is shown below.

| Processing Steps | Processing Temperature | Processing Time | Replenishing Amount |
|---|---|---|---|
| Color Developing | 80° C. | 7 sec. | 40 ml |
| Bleach Fixing | 38.0 ± 0.5° C. | 7 sec. | 60 ml |
| Stabilizing | 30.0 – 34.0° C. | 16 sec. | 120 ml |
| Drying | 60 – 80° C. | 15 sec. | |

The developing solution composition will be illustrated as below:

Color developing solution: first solution composition (a)

| | |
|---|---|
| Deionized water | 500 ml |
| Potassium sulfite | 1.0 g |
| Pentasodium salt of diethylenetriamine pentaacetic acid | 3.0 g |
| Sodium p-toluenesulfonate | 20.0 g |
| N-ethyl-N-(β-methanesulfonamide ethyl-3-methyl-4-aminoaniline sulfate | 43.0 g |

Water was added to make 1 liter in total and pH was ajusted to 2.0 using potassium hydroxide or 50% sulfuric acid.

Color developing solution:
second solution composition (b)

| | |
|---|---|
| Deionized water | 500 ml |
| Potassium chloride | 10.0 g |
| Pentasodium salt of diethylenetriamine pentaacetic acid | 3.0 g |
| Potassium carbonate | 82.0 g |
| Sodium p-toluenesulfronate 15.0 | g |

Water was added to make 1 liter in total and pH was adjusted to 13.5 using potassium hydroxide or 50% sulfuric acid.

The same bleach fixing process and stabilizing process as employed in Example 16 were used.

What is claimed is:

1. A silver halide color print photographic light-sensitive material comprising a support having thereon at least a light-sensitive silver halide emulsion layer containing a light-sensitive silver halide emulsion and at least a nonlight-sensitive layer, wherein said silver halide photographic light-sensitive material contains a compound represented by the following formula (1) and said silver halide photographic light-sensitive material further contains a vinylsulfone group containing hardener;

$$HOCH_2(CHOH)_mCH_2OH \qquad \text{Formula (1)}$$

wherein m represents an integer of 0 to 6, and said light-sensitive silver halide emulsion consists of an average silver chloride content ratio of not less than 95 mol %, and a nonlight-sensitive layer provided farthest from said support contains a betaine type surfactant.

2. The silver halide photographic light-sensitive material of claim 1, wherein said silver halide photographic light-sensitive material comprises a nonlight-sensitive hydrophilic colloidal layer coated in a coated gelatin amount of 0.01 to 1.0 g/m$^2$ between a light-sensitive silver halide emulsion layer nearest to said support and said support.

3. The silver halide photographic light-sensitive material of claim 1, wherein surface of said support is subjected to an energy treatment to produce an reactive group capable of being hardened by a hardener.

4. The silver halide photographic light-sensitive material of claim 1, wherein said light-sensitive silver halide emulsion layer contains at least a yellow coupler represented by the following formula [Y-1], Formula [Y-1]

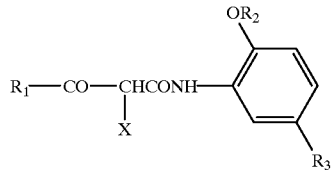

wherein $R_1$ represents an aliphatic group or an aromatic group; $R_2$ represents a nondiffisuble aliphatic or a nondiffusible aromatic group; $R_3$ represents a hydrogen atom or a hologen atom; while X represents a five or six membered nitrogen containing heterocyclic group which is released when said yellow coupler couples with an oxidized color developer.

5. The silver halide photographic light-sensitive material of claim 1, wherein said silver halide photographic light-sensitive material contains at least a fluorine containing surfactant.

6. The silver halide photographic light-sensitive material of claim 2, wherein a coated gelatin amount of said nonlight-sensitive hydrophilic colloidal layer coated between said light-sensitive silver halide emulsion layer nearest to said support and said support is between 0.03 to 0.8 g/m$^2$.

7. The silver halide photographic light-sensitive material of claim 1, wherein said vinylsulfone group containing hardener is represented by the following formula [H-1],

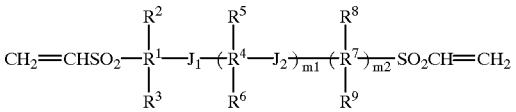

wherein $R^1$, $R^4$ and $R^7$ each represent an alkylene group and an arylene group, $R^2$, $R^3$, $R^5$ $_1$ $R^6$, $R^8$ and $R^9$ each represent a hydrogen atom, an alkyl group, a hydroxyl group or a vinylsulfone group. $J_1$ and $J_2$ each represent —O—, —S—, —(C═O)—, —CH(OH)—, —NHCO— or —CONH—, and $m_1$ and $m_2$ each represent 0 or 1.

8. The silver halide photographic light-sensitive material of claim 1, wherein said compound represented by the formula (1) is contained in an amount of not more than 1 g/m$^2$.

9. The silver halide photographic light-sensitive material of claim 1, wherein at least one of said silver halide light-sensitive emulsion layer and said nonlight-sensitive layer contains gelatin and a coated amount of said gelatin is not more than 6.5 g/m$^2$ in total.

10. The silver halide photographic light-sensitive material of claim 1, wherein said silver halide light-sensitive material contains a silver halide in total amount of not more than 0.6 g/m$^2$ in terms of silver amount in said light-sensitive silver halide emulsion layer.

* * * * *